US011415128B2

(12) United States Patent
Saga et al.

(10) Patent No.: US 11,415,128 B2
(45) Date of Patent: Aug. 16, 2022

(54) VARIABLE DISPLACEMENT PUMP AND CONTROL METHOD THEREFOR

(71) Applicant: HITACHI AUTOMOTIVE SYSTEMS, LTD., Hitachinaka (JP)

(72) Inventors: Koji Saga, Ebina (JP); Hideaki Ohnishi, Atsugi (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 136 days.

(21) Appl. No.: 16/624,052

(22) PCT Filed: Jun. 8, 2018

(86) PCT No.: PCT/JP2018/021969

§ 371 (c)(1),
(2) Date: Dec. 18, 2019

(87) PCT Pub. No.: WO2018/235627

PCT Pub. Date: Dec. 27, 2018

(65) Prior Publication Data

US 2020/0141403 A1 May 7, 2020

(30) Foreign Application Priority Data

Jun. 22, 2017 (JP) ..... JP2017-121943

(51) Int. Cl.
*F03C 2/00* (2006.01)
*F03C 4/00* (2006.01)
(Continued)

(52) U.S. Cl.
CPC ..... *F04C 14/226* (2013.01); *F04C 2/344* (2013.01); *F04C 14/18* (2013.01); *F04C 14/223* (2013.01); *F04C 14/24* (2013.01); *F04C 15/06* (2013.01)

(58) Field of Classification Search
CPC ..... F04C 2/344; F04C 14/18; F04C 14/24; F04C 14/223; F04C 14/226; F04C 15/06; F04C 2210/206
See application file for complete search history.

(56) References Cited

U.S. PATENT DOCUMENTS 5,085,051 A * 2/1992 Hirata ..... F15B 11/055 60/368
2008/0038117 A1* 2/2008 Armenio ..... F04C 14/223 417/26

(Continued)

FOREIGN PATENT DOCUMENTS

JP 2014066178 A * 4/2014 ..... F04C 14/226
JP 2016-048071 A 4/2016

OTHER PUBLICATIONS

International Search Report issued in corresponding application No. PCT/JP2018/021969 dated Sep. 4, 2018.

(Continued)

*Primary Examiner* — Theresa Trieu
(74) *Attorney, Agent, or Firm* — Foley & Lardner LLP

(57) ABSTRACT

A variable displacement pump device includes a pump, a mover, a biasing member, first and second control chambers, and a controller. The first and second control chambers are provided between an inner periphery of a containing chamber of a housing and an outer periphery of the mover. Hydraulic oil is introduced from a discharge port into the first control chamber. The pump is configured to permit oil to be introduced from the discharge port into the second control chamber via a supply/discharge passage or to be discharged from inside the second control chamber. The second control chamber is located adjacent to any of the pump chambers in a discharge region or the discharge port via the mover. The controller is configured to switch states (Continued)

in which the second control chamber is opened and closed to the supply/discharge passage.

17 Claims, 14 Drawing Sheets

(51) Int. Cl.

| | |
|---|---|
| ***F04C 2/00*** | (2006.01) |
| ***F04C 14/18*** | (2006.01) |
| ***F04C 14/22*** | (2006.01) |
| ***F04C 14/24*** | (2006.01) |
| ***F04C 15/06*** | (2006.01) |
| ***F04C 2/344*** | (2006.01) |

(56) References Cited

U.S. PATENT DOCUMENTS

| | | | | |
|---|---|---|---|---|
| 2017/0167488 | A1* | 6/2017 | Patterson | F04C 14/226 |
| 2019/0226479 | A1* | 7/2019 | Watanabe | F04C 14/226 |

OTHER PUBLICATIONS

Written Opinion issued in corresponding application No. PCT/JP2018/021969 dated Sep. 4, 2018.

* cited by examiner

VARIABLE DISPLACEMENT PUMP AND CONTROL METHOD THEREFOR

TECHNICAL FIELD

The present invention relates to a variable displacement pump.

BACKGROUND ART

There have been known variable displacement pumps. For example, a variable displacement pump disclosed in PTL 1 includes a movable member defining a pump chamber. The variable displacement pump can vary a change amount (a capacity) of the volume of the pump chamber with the aid of a movement of the movable member. This pump causes the movable member to move by adjusting a pressure in a control chamber that is applied to the movable member.

CITATION LIST

Patent Literature

[PTL 1] Japanese Patent Application Public Disclosure No. 2016-48071

SUMMARY OF INVENTION

Technical Problem

The variable displacement pump has such a risk that the movable member may unintentionally move independently of the pressure in the control chamber when balance is lost among pressures applied from the pump chamber to the movable member.

Solution to Problem

According to one aspect of the present invention, preferably, a variable displacement pump includes a control mechanism capable of switching a state in which a control chamber is opened to a supply/discharge passage and a state in which the control chamber is closed to the supply/discharge passage.

The variable displacement pump according to the one aspect of the present invention can prevent the unintended movement of the movable member by establishing the state in which the control chamber is closed to the supply/discharge passage, thereby being able to improve controllability.

DESCRIPTION OF EMBODIMENTS

In the following description, embodiments for implementing the present invention will be described with reference to the drawings.

First Embodiment

Figure 1:
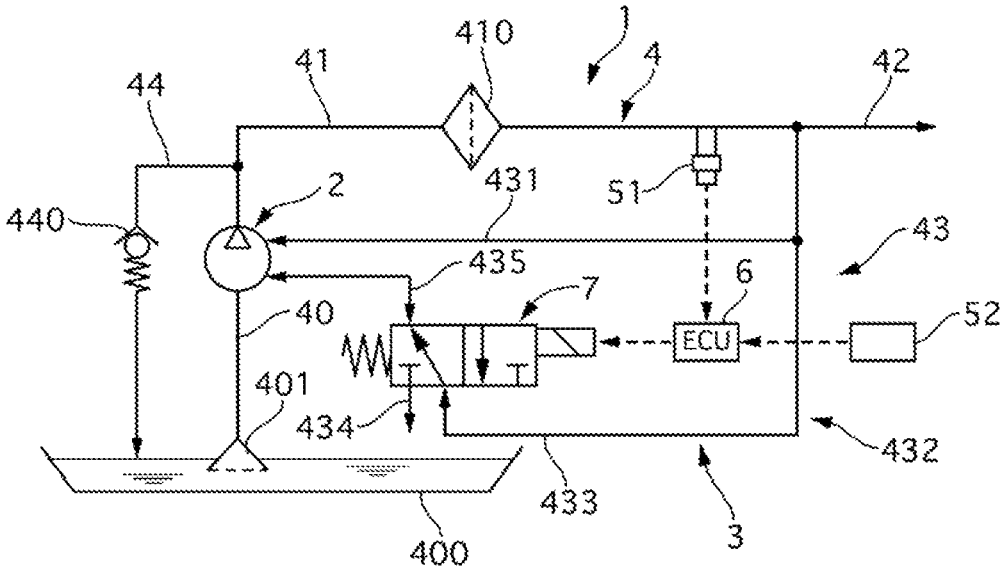
FIG. 1 illustrates a circuit of a hydraulic oil supply system of an engine according to a first embodiment.

First, a configuration will be described. A variable displacement pump (hereinafter referred to as a pump) 2 according to the present embodiment is an oil pump used in a hydraulic oil supply system 1 of an internal combustion engine (an engine) of an automobile. The pump 2 is mounted at, for example, a front end portion of a cylinder block of the engine, and supplies oil (hydraulic oil), which is fluid fulfilling a lubrication function and other functions, to each sliding portion of the engine and a movable valve device (a valve timing controller or the like), which variably controls an actuation characteristic of a valve of the engine. As illustrated in FIG. 1, the system 1 includes an oil pan 400, an oil gallery (passage) 4, the pump 2, a pressure sensor (a pressure measurement portion) 51, a rotation number sensor (a rotation number measurement portion) 52, and an engine control unit (a controller) 6. The oil pan 400 is located at a lower portion of the engine, and is a low-pressure portion in which the hydraulic oil is stored. The passage 4 is, for example, located inside the cylinder block, and includes an intake passage 40, a discharge passage 41, a main gallery 42, a control passage 43, and a relief passage 44. One end of the intake passage 40 is connected to the oil pan 400 via an oil filter 401. The other end of the intake passage 40 is connected to the pump 2. One end of the discharge passage 41 is connected to the pump 2. The other end of the discharge passage 41 is connected to an oil filter 410. One end of the main gallery 42 is connected to the oil filter 410. The main gallery 42 can supply the hydraulic oil to each sliding portion of the engine, the movable valve device, and the like. A pressure sensor 51 is mounted in the main gallery 42. The relief passage 44 branches off from the discharge passage 41, and can discharge the hydraulic oil to the oil pan 400. A relief valve 440 is mounted in the relief passage 44.

Figure 2:
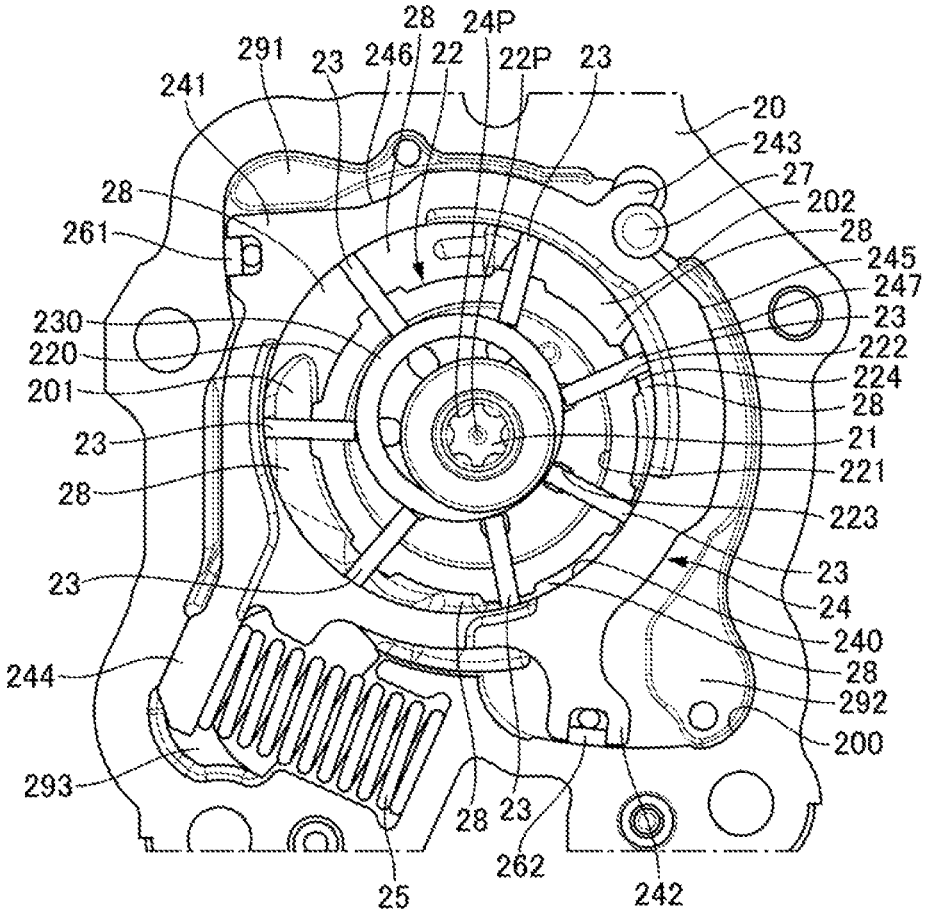
FIG. 2 is a front view of a part of a pump according to the first embodiment.

As illustrated in FIG. 2, the pump 2 is a vane pump. The pump 2 includes a housing, a driving shaft 21, a rotor 22, a plurality of vanes 23, a cam ring 24, a spring (a biasing member, a biaser) 25, a first seal member 261, a second seal member 262, a pin 27, and a control mechanism (a controller) 3. The housing includes a housing main body 20 and a cover. FIG. 2 illustrates a part of the pump 2 with the cover removed therefrom. The housing main body 20 includes a pump containing chamber 200, an intake inlet, and a discharge outlet therein. The pump containing chamber 200 has a bottomed cylindrical shape, and is opened to a one-side surface of the housing main body 20. A hole in which the driving shaft 21 is contained (a shaft containing hole) and a hole in which the pin 27 is fixed (a pin hole) are opened on a bottom surface of the pump containing chamber 200. The cover is attached to the one-side surface of the housing main body 20 with use of a plurality of bolts or the like, and closes the above-described opening of the pump containing chamber 200. One end of the intake inlet is opened to an outer surface of the housing main body 20, and the other end of the intake passage 40 is connected thereto. The other end of the intake inlet is opened to the bottom surface of the pump containing chamber 200 as an intake port 201. The intake port 201 is a groove (a recessed portion) extending in a direction around the above-described shaft containing hole, and is located on an opposite side of the above-described shaft containing hole from the above-described pin hole. One end of the discharge outlet is opened to the bottom surface of the pump containing chamber 200 as a discharge port 202. The discharge port 202 is a groove (a recessed portion) extending in the direction around the above-described shaft containing hole, and is located on the same side of the above-described shaft containing hole as the above-described pin hole. The other end of the discharge outlet is opened to the outer surface of the housing main body 20, and the one end of the discharge passage 41 is connected thereto. Grooves corresponding to the intake port 201 and the discharge port 202 of the housing main body 20 are also provided on a surface of the cover that closes pump containing chamber 200. The rotor 22, the plurality of vanes 23, the cam ring 24, and the spring 25 are provided inside the pump containing chamber 200.

The driving shaft 21 is rotatably supported on the housing. The driving shaft 21 is coupled with a crankshaft via a chain, a gear, or the like. The rotor 22 is columnar. The rotor 22 is circumferentially fixed to the driving shaft 21, and rotates around a central axis 22P in a clockwise direction in FIG. 2. A recessed portion 221 is provided on a surface of the rotor 22 on one axial side. A plurality of (seven) radially extending slits 222 is provided inside the rotor 22. A back-pressure chamber 223 is provided on a radially inner side of the slits 222. Radially outwardly protruding protrusion portions 224 are provided on an outer peripheral surface 220 of the rotor 22. The slits 222 are opened to the protrusion portions 224. The vanes 23 are contained in the slits 222. An annular member 230 is mounted in the recessed portion 221. An outer peripheral surface of the member 230 faces a proximal end of each of the vanes 23. An inner peripheral surface 240 of the cam ring 24 is cylindrical. An outer periphery of the cam ring 24 includes four protrusions 241 to 244 protruding radially outwardly. The first seal member 261 is mounted on the first protrusion 241. The second seal member 262 is mounted on the second protrusion 242. The pin 27 is fitted to the third protrusion 243. As viewed from an axial direction of the cam ring 24, the first protrusion 241 and the second protrusion 242 are located on opposite sides of a straight linear line passing through a central axis of the pin 27 and a central axis 24P of the cam ring inner peripheral surface 240 from each other. One end of the spring 25 is set on the fourth protrusion 244.

A first control chamber 291, a second control chamber 292, and a spring containing chamber 293 are provided between the housing and the cam ring 24 inside the pump containing chamber 200. The first control chamber 291 is a space between a portion of an outer peripheral surface 245 of the cam ring 24 from the first protrusion 241 (the first seal member 261) to the third protrusion 243 (the pin 27), and an inner peripheral surface of the housing (the pump containing chamber 200). The first control chamber 291 is sealed by the first seal member 261 and the pin 27. A first region 246 between the first seal member 261 and the pin 27 on the cam ring outer peripheral surface 245 faces the first control chamber 291. The second control chamber 292 is a space between a portion of the outer peripheral surface 245 of the cam ring 24 from the second protrusion 242 (the second seal member 262) to the third protrusion 243 (the pin 27), and the inner peripheral surface of the housing (the pump containing chamber 200). The second control chamber 292 is sealed by the second seal member 262 and the pin 27. A second region 247 between the second seal member 262 and the pin 27 on the cam ring outer peripheral surface 245 faces the second control chamber 292. The area of the second region 247 (the angle occupied by the second region 247 in the circumferential direction of the cam ring 24, i.e., the direction around the central axis 24P) is slightly larger than the area of the first region 246 (the angle occupied by the first region 246 in the circumferential direction of the cam ring 24). A portion of the cam ring 24 that corresponds to the second region 247 except for the protrusion 242 (an axial end surface of the cam ring 24 continuous to the second region 247 and facing the bottom surface of the pump containing chamber 200) is averagely larger in radial width at least in a region radially adjacent to the discharge port 202 than a portion corresponding to the first region 246 except for the protrusions 241 and 243 (an axial end surface of the cam ring 24 continuous to the first region 246 and facing the bottom surface of the pump containing chamber 200). The spring containing chamber 293 is a space between a portion of the cam ring outer peripheral surface 245 from the first protrusion 241 (the first seal member 261) to the second protrusion 242 (the second seal member 262) via the fourth protrusion 244, and the inner peripheral surface of the housing (the pump containing chamber 200). The spring 25 is a compression coil spring. The one end of the spring 25 is in contact with a surface of the fourth protrusion 244 on one side in the circumferential direction of the cam ring 24. A surface of the fourth protrusion 244 on the other side in the circumferential direction of the cam ring 24 faces the inner peripheral surface of the pump containing chamber 200 (the spring containing chamber 293), and is abuttable with this inner peripheral surface. The other end of the spring 25 is set on the inner peripheral surface of the pump containing chamber 200 (the spring containing chamber 293). The spring 25 is kept in a compressed state and has a predetermined set load in an initial state where the cam ring 24 is not actuated, thereby constantly biasing the fourth protrusion 244 to the other side in the above-described circumferential direction.

The control mechanism 3 includes a control passage 43 and a control valve 7. As illustrated in FIG. 1, the control passage 43 includes a first feedback passage 431 and a second feedback passage 432. One end side of the first feedback passage 431 branches off from the main gallery 42. The other end of the first feedback passage 431 is connected to the first control chamber 291. The second feedback passage 432 includes a supply passage 433, a discharge passage 434, and a communication passage 435. One end side of the supply passage 433 branches off from the first feedback passage 431. The other end of the supply passage 433 is connected to the control valve 7. One end of the discharge passage 434 is connected to the control valve 7. The other end of the discharge passage 434 is connected to the oil pan 400. One end of the communication passage 435 is connected to the control valve 7. The other end of the communication passage 435 is connected to the second control chamber 292.

Figure 3:
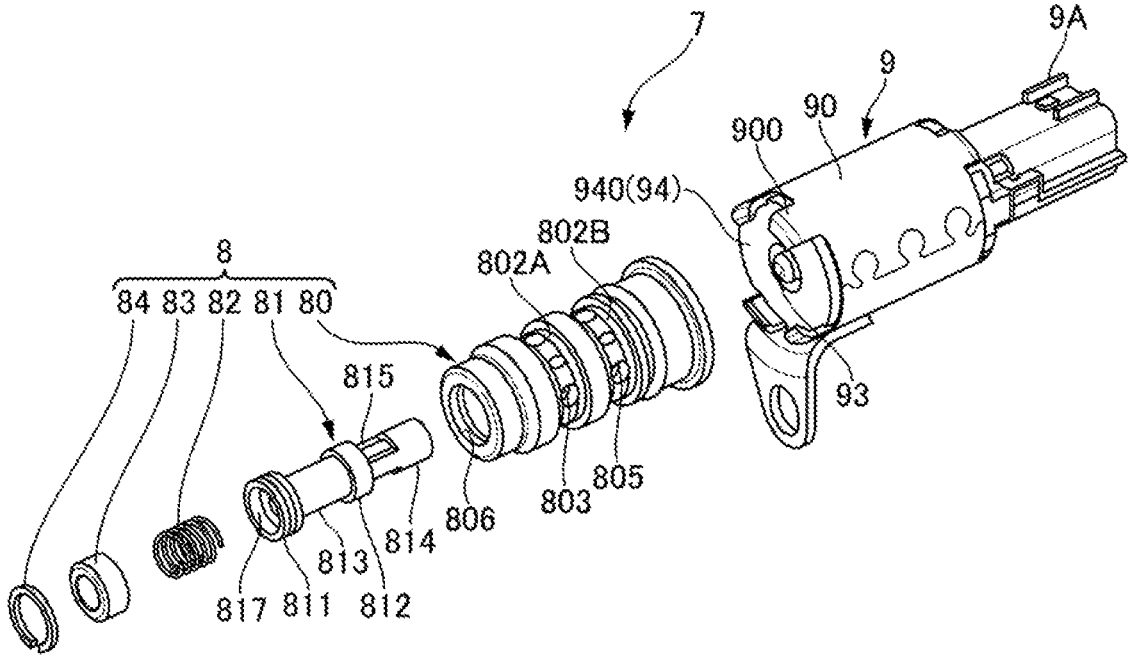
FIG. 3 is an exploded perspective view of a control valve according to the first embodiment.
Figure 4:
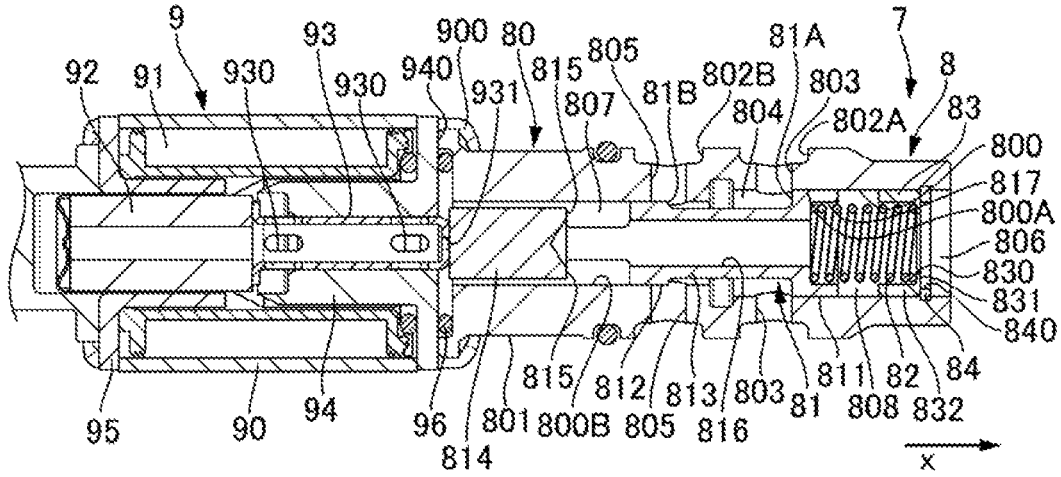
FIG. 4 is a cross-sectional view passing through a central axis of the control valve according to the first embodiment.

As illustrated in FIGS. 3 and 4, the control valve 7 is an electromagnetic valve (a solenoid valve), and includes a valve portion 8 and a solenoid portion 9. The valve portion 8 is a three-way valve, and includes a cylinder (a cylindrical portion) 80, a spool 81, a spring (a spool biasing member) 82, a retainer 83, and a stopper 84. The solenoid portion 9 includes a case 90, a coil 91, a plunger (a movable iron core) 92, a rod 93, a fixed iron core 94, and a sleeve 95. The cylinder 80 has a cylindrical shape including a stepped inner peripheral surface 800. Both ends of the cylinder 80 in an axial direction thereof (a direction in which a central axis thereof extends) are opened. Hereinafter, an x axis will be set along the axial direction of the cylinder 80, and one side and the other side in the axial direction of the cylinder 80 will be defined to be a positive side and a negative side, respectively. The inner peripheral surface 800 includes a large diameter portion 800A and a small diameter portion 800B. The diameter of the large diameter portion 800A is larger than the diameter of the small diameter portion 800B. The large diameter portion 800A and the small diameter portion 800B are located on the x-axis positive direction side and the x-axis negative direction side, respectively. Annular grooves 802A and 802B are provided on an outer peripheral surface 801 of the cylinder 80. The annular grooves 802A and 802B extend in a direction around a central axis (a circumferential direction) of the cylinder 80. A plurality of ports 803, 805, and 806 are provided inside the cylinder 80. These grooves 802A and 802B and ports 803, 805, and 806 function as a part of the second feedback passage 432 together with a space on the inner peripheral side of the cylinder 80. The supply ports 803 and the communication ports 805 are holes radially penetrating through the cylinder 80. A plurality of supply ports 803 is arranged in the circumferential direction, and is opened to the large diameter portion 800A and the annular groove 802A. A plurality of communication ports 805 is arranged in the circumferential direction, and is opened to the small diameter portion 800B and the annular groove 802B. The shapes of openings of these ports are circular. The discharge port 806 is an opening portion of the cylinder 80 on the x-axis positive direction side. The other end of the supply passage 433 is connected to the annular groove 802A (the supply ports 803). The supply ports 803 are in communication with the discharge port 202 via the supply passage 433 (the second feedback passage 432), the main gallery 42, and the discharge passage 41. The supply ports 803 can introduce the hydraulic oil from the discharge port 202 into the cylinder 80. The one end of the communication passage 435 is connected to the annular groove 802B (the communication ports 805). The communication ports 805 are in communication with the second control chamber 292 via the communication passage 435. The communication ports 805 establish communication between inside the cylinder 80 and the second control chamber 292. The one end of the discharge passage 434 is connected to the discharge port 806. The discharge port 806 can discharge the hydraulic oil from inside the cylinder 80 into the oil pan 400 via the discharge passage 434.

The spool 81 is a columnar valve body (valve) provided in the second feedback passage 432, and is reciprocable in the x-axis direction inside the cylinder 80. The spool 81 includes a first land portion 811, a second land portion 812, a first shaft portion 813, and a second shaft portion 814. The first land portion 811 is located at an end of the spool 81 on the x-axis positive direction side. The second land portion 812 is located at an intermediate position of the spool 81 in the x-axis direction. The first shaft portion 813 corresponds to a groove portion located between the first land portion 811 and the second land portion 812, and connects both the land portions 811 and 812 to each other. The second shaft portion 814 is connected to an x-axis negative direction side of the second land portion 812. The diameter of the first land portion 811 is slightly smaller than the diameter of the large diameter portion 800A. The diameter of the second land portion 812 is slightly smaller than the diameter of the small diameter portion 800B. The diameter of the first land portion 811 is larger than the diameter of the second land portion 812. The diameters of both the shaft portions 813 and 814 are equal to each other, and are smaller than the diameter of the second land portion 812. A distance in the x-axis direction between an end of the first land portion 811 on the x-axis negative direction side and an end of the second land portion 812 on the x-axis positive direction side is longer than a distance between ends of the supply ports 803 on the x-axis negative direction side and ends of the communication ports 805 on the x-axis positive direction side. The dimension of an outer peripheral surface of the second land portion 812 in the x-axis direction is substantially (within a range of a tolerance) equal to the diameters of the communication ports 805 (a distance between the ends of the openings of the communication ports 805 on the x-axis positive direction side and the ends thereof on the x-axis negative direction side on the small diameter portion 800B). Holes 815 and a hole 816 are provided inside the spool 81. The holes 815 and the hole 816 extend in a radial direction of the spool 81 and in the x-axis direction, receptively. A bottomed cylindrical recessed portion 817 is provided on an end surface of the spool 81 (the first land portion 811) on the x-axis positive direction side. A plurality of (two) holes 815 is provided, and is arranged circumferentially (radially oppositely) at portions on the x-axis positive direction side of the second shaft portion 814 and adjacent to the second land portion 812. The hole 816 extends on a central axis of the spool 81. An x-axis positive direction side of the hole 816 is opened to a bottom portion of the recessed portion 817, and an x-axis negative direction side of the hole 816 is connected to the plurality of holes 815.

The retainer 83 is provided at an end of the large diameter portion 800A on the x-axis positive direction side. The retainer 83 has a bottomed cylindrical shape, and includes a bottom portion 831 and a cylindrical portion 832. A hole 830 is provided on the bottom portion 831. The cylindrical portion 832 of the retainer 83 is fitted to the inner periphery of the cylinder 80 (the large diameter portion 800A). The stopper 84 is annular, and includes a hole 840 at a central portion thereof. The stopper 84 is fixed to an x-axis positive direction side of the retainer 83 on the large diameter portion 800A. A surface of the stopper 84 on the x-axis negative direction side is in contact with the bottom portion 831 of the retainer 83.

The first land portion 811 is in sliding contact with the large diameter portion 800A, and the second land portion 812 is in sliding contact with the small diameter portion 800B. Inside the cylinder 80, a space 804, a space 807, and a space 808 are defined between the first land portion 811 and the second land portion 812, between the second land portion 812 and the solenoid portion 9 (the fixed iron core 94), and between the first land portion 811 and the retainer 83, respectively. The space 804 has a stepped cylindrical shape, and is located among the inner peripheral surface 800A or 800B of the cylinder 80, the outer peripheral surface of the first shaft portion 813, the surface of the second land portion 812 on the x-axis positive direction side, and the surface of the first land portion 811 on the x-axis negative direction side. The supply ports 803 are constantly opened to the space 804, and the communication ports 805 are opened in the initial state where the spool 81 is not actuated. The space 807 is cylindrical, and located among the inner peripheral surface 800B of the cylinder 80, the outer peripheral surface of the second shaft portion 814, the surface of the second land portion 812 on the x-axis negative direction side, and a surface 940 of the fixed iron core 94 on the x-axis positive direction side. The holes 815 are constantly opened to the space 807, and the communication ports 805 can be opened to the space 807. The space 808 is located among the inner peripheral surface 800A of the cylinder 80, the surface of the second land portion 812 (including the recessed portion 817) on the x-axis positive direction side, and the surface of the retainer 83 on the x-axis negative direction side. The space 808 is constantly in communication with the discharge port 806 via the holes 830 and 840.

The spring 82 is a compression coil spring, and is mounted in the space 808. The space 808 functions as a spring chamber that contains the spring 82. One end side of the spring 82 is fitted to the inner peripheral side of the retainer 83, and the one end of the spring 82 is in contact with the bottom portion 831 of the retainer 83. The other end side of the spring 82 is fitted to the recessed portion 817 of the spool 81, and the other end of the spring 82 is in contact with the bottom surface of the recessed portion 817. The spring 82 is kept in a compressed state and has a predetermined set load in an initial state, thereby constantly biasing the spool 81 to the x-axis negative direction side.

The solenoid portion 9 is coupled with the x-axis negative direction side of the valve portion 8 and closes the opening of the cylinder 80 on the x-axis negative direction side. The solenoid portion 9 is an electromagnet that receives supply of a current via a connector 9A and an electric wire. The coil 91 is fixed to an inner peripheral side of the case 90. The fixed iron core 94 is fixed to an x-axis positive direction side of the case 90 (the coil 91), and the sleeve 95 is fixed to an x-axis negative direction side of the case 90 (the coil 91). The end of the case 90 on the x-axis positive direction side is fixed to the end of the cylinder 80 on the x-axis negative direction side. An O-ring 96 is mounted in a compressed state between the surface 940 of the fixed iron core 94 and the surface of the cylinder 80 on the x-axis negative direction side. The plunger 92 is made from a magnetic material, and is mounted movably in the x-axis direction on an inner peripheral side of the sleeve 95. The rod 93 is a different member (another member) from the spool 81 and the plunger 92. The rod 93 is mounted reciprocably in the x-axis direction on an inner peripheral side of the fixed iron core 94. The rod 93 has a bottomed cylindrical shape. A plurality of (four) holes 930 is circumferentially arranged on a circumferential wall of the rod 93 on both sides in the x-axis direction. The holes 930 radially penetrate through the rod 93. A hole 931 is provided on a bottom portion of the rod 93 on the x-axis positive direction side. The hole 931 penetrates through the rod 93 in the x-axis direction. A surface of the rod 93 (the bottom portion thereof) on the x-axis positive direction side is in contact with the surface of the spool 81 (the second shaft portion 814) on the x-axis negative direction side. A flange portion located on an end of the rod 93 in the x-axis negative direction is in contact with a surface of the plunger 92 on the x-axis positive direction side. The holes 930 establish communication between both sides of the fixed iron core 94 in the x-axis direction via the inner peripheral side of the rod 93. This facilitates the movement of the rod 93 in the x-axis direction relative to the fixed iron core 94. The coil 91 generates an electromagnetic force by receiving power supply. The plunger 92 is biased toward the x-axis positive direction side by the above-described electromagnetic force. The rod 93 functions as a member used for the solenoid portion 9 to bias the spool 81 toward the x-axis positive direction side. Due to the above-described electromagnetic force, the plunger 92 biases the spool 81 toward the x-axis positive direction side via the rod 93. Assume that fm represents this electromagnetic force (a solenoid thrust force, which is a force for thrusting the spool 81). The solenoid portion 9 can continuously change the value of fm according to the value of the supplied current. The solenoid portion 9 is subjected to pulse width modulation (PWM) control, and a current value thereof is provided in the form of a duty ratio D. The electromagnetic force fm varies according to D (the current value). For example, when D is lower than a predetermined value D1 (a dead zone), fm is kept at a minimum value, zero (is not generated) regardless of the value of D. When D is D1 or higher and lower than a predetermined value D2, fm changes according to D and increases as D increases. When D is D2 or higher, fm is kept at a maximum value, fmax regardless of the value of D.

The pressure sensor 51 detects (measures) a pressure (a main gallery hydraulic pressure) P1 of the main gallery 42. The rotation number sensor 52 detects (measures) the number of rotations Ne of the engine (the crankshaft).

The engine control unit (hereinafter referred to as the ECU) 6 controls an opening/closing operation of the control valve 7 (i.e., a discharge amount of the pump 2) based on input information and a built-in program. By this control, the ECU 6 controls a pressure and a flow rate of the hydraulic oil to be supplied to the engine. The ECU 6 includes a reception portion, a central processing unit (CPU), a read only memory (ROM), a random access memory (RAM), and a driving circuit, and is mainly constituted by a microcomputer in which they are connected to one another via a bidirectional common bus. The reception portion receives information regarding values detected by the pressure sensor 51 and the rotation number sensor 52, and another engine operational state (an oil temperature, a water temperature, an engine load, and the like). The ROM is a storage portion storing a control program, map data, and the like therein. The CPU is a calculation portion that carries out a calculation with use of the information input from the reception portion based on the read control program. The CPU calculates the current value to supply to the control valve 7 (the solenoid portion 9) and carries out other calculations, and outputs a control signal according to a calculation result to the driving circuit. The driving circuit supplies power to the solenoid portion 9 according to the control signal from the CPU, thereby controlling the current supply to the solenoid portion 9. The driving circuit is a PWM control circuit, and changes a pulse width (the duty ratio D) of a driving signal directed to the solenoid portion 9 according to the control signal.

Next, an operation of the pump will be described. An alternate long and short dash line indicates a flow of the hydraulic oil in each of FIGS. 5 to 7. A rotation of the crankshaft is transmitted to the driving shaft 21 of the pump 2 via the chain and the gear. The driving shaft 21 rotationally drives the rotor 22. The rotor 22 rotates in the clockwise direction in each of FIGS. 5 to 7. Components forming the pump (a pump forming member), including the rotor 22, discharge the hydraulic oil guided from the intake inlet and the intake port 201 from the discharge port 202 and the discharge outlet by being rotationally driven. The pump 2 sucks the hydraulic oil from the oil pan 400 via the intake passage 40 and discharges the hydraulic oil to the discharge passage 41. The pump 2 pressure-feeds the hydraulic oil to each portion of the engine via the main gallery 42 connected to the discharge passage 41. The relief valve 440 is opened and discharges the hydraulic oil from the discharge passage 41 via the relief passage 44, when a pressure in the discharge passage 41 (a discharge pressure) reaches a predetermined high pressure. The cam ring 24 forms a plurality of pump chambers (vane chambers) 28 by containing the rotor 22 and the plurality of vanes 23. The plurality of vanes 23 functions as the pump forming member. The vane chambers 28 are separated and formed (defined) by the outer peripheral surface 220 of the rotor 22, the two vanes 23 adjacent to each other, the cam ring inner peripheral surface 240, the bottom surface of the pump containing chamber 200, and the side surface of the cover. The volumes of the vane chambers 28 can change according to the rotation of the rotor 22, and a pump function is exerted with the aid of increases and reductions in the volumes of the vane chambers 28 according to the rotation. The intake port 201 is opened in a range (an intake region) where the volumes of the vane chambers 28 increase (according to the rotation of the rotor 22). The vane changers 28 in the intake region suck the hydraulic oil from the intake port 201. The discharge port 202 is opened in a range (a discharge region) where the volumes of the vane chambers 28 reduce (according to the rotation of the rotor 22). The vane chambers 28 in the discharge region discharge the hydraulic oil to the discharge port 202. A theoretical discharge amount (a discharge amount per rotation), i.e., the capacity of the pump 2 is determined based on a difference between maximum volumes and minimum volumes of the vane chambers 28.

A change amount of the volume of each of the vane chambers 28 (the difference between the maximum volume and the minimum volume) is changeable. The cam ring 24 is a member capable of moving (a movable member, a mover) inside the pump containing chamber 200, and can rotationally swing around the pin 27. The pin 27 functions as a pivot portion (a support portion) located inside the pump containing chamber 200. The rotational swing of the cam ring 24 causes a change in the difference between the central axis 22P of the rotor 22 and the central axis 24P of the cam ring inner peripheral surface 240 (an eccentricity amount Δ). The change in the eccentricity amount Δ causes a change in the increase/reduction amount of the volume of each of the plurality of vane chambers 28 at the time of the rotation of the rotor 22. In other words, the pump 2 is a variable displacement pump, and can increase the capacity thereof by increasing Δ while reducing the capacity thereof by reducing Δ. Further, the volumes of the first control chamber 291 and the second control chamber 292 can change when the cam ring 24 moves. The intake region and the discharge region extend over the central axis 22P of the rotor 22 in the movement direction of the cam ring 24. The first control chamber 291 and the second control chamber 292 are adjacent to the vane chambers 28 and the discharge port 202 in the discharge region via the cam ring 24 in the radial direction of the cam ring 24. The pressure in the discharge port 202 is introduced into back-pressure chambers 223 and the vanes 23 are pushed out from the slits 222, by which liquid-tightness of the vane chambers 28 is improved. Even when the number of rotations of the engine is low and the centrifugal force and the pressures in the back-pressure chambers 223 are low, the liquid tightness of the vane chambers 28 is improved by the annular member 230 pushing the vanes 23 out of the slits 222.

Figure 5:
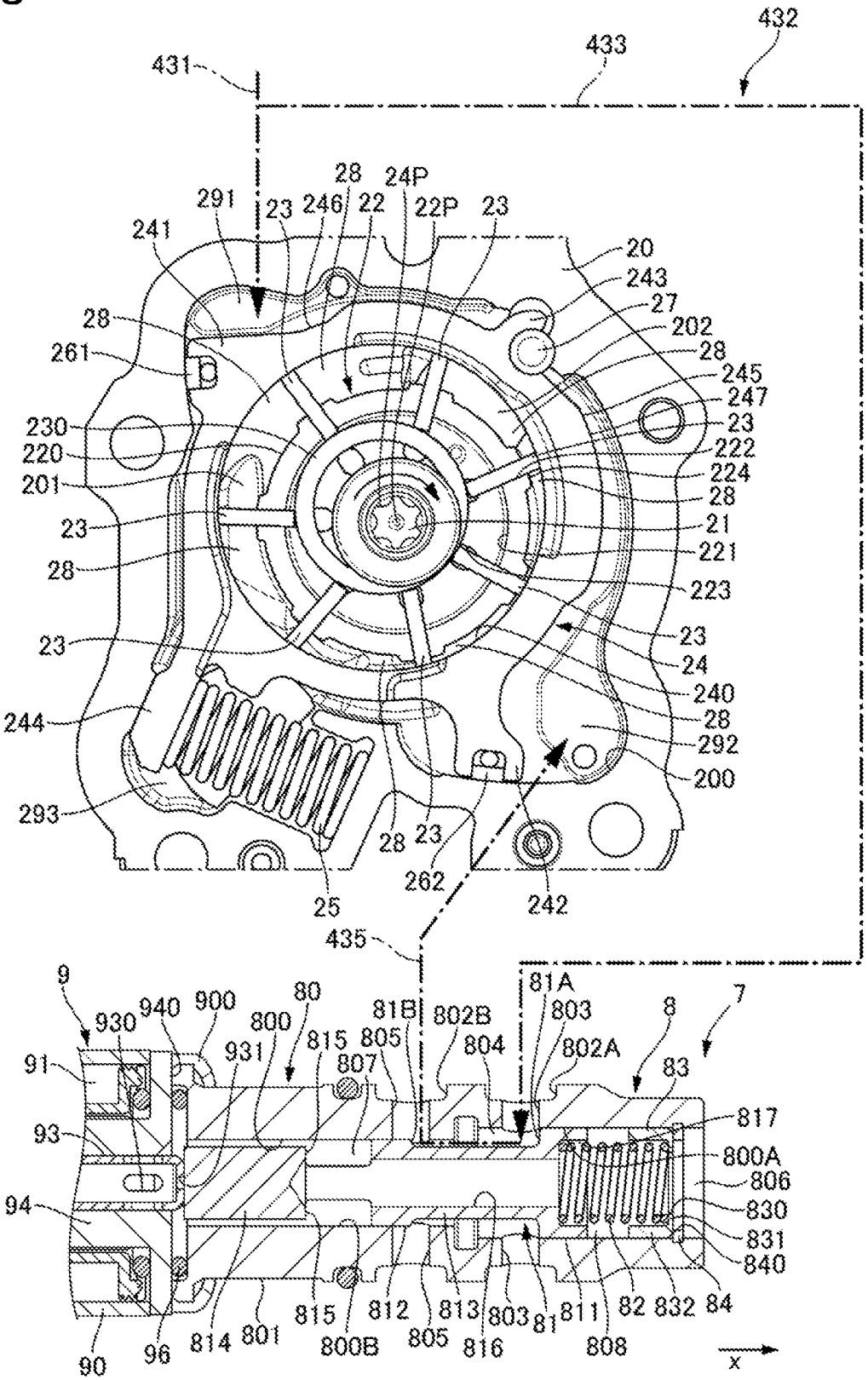
FIG. 5 illustrates an actuation state (a first state) of the pump according to the first embodiment.

The cam ring 24 is biased by the spring 25 toward one side in a direction of the rotation around the pin 27 (which is the clockwise direction in FIG. 5 and is one side that leads to the increase in the increase/reduction amount of the volume of each of the plurality of vanes 28 and the increase in the eccentricity amount Δ). Assume that Fs represents this spring force. The cam ring 24 receives the pressure of the hydraulic oil contained inside the first control chamber 291. The first region 246 of the cam ring outer peripheral surface 245 functions as a first pressure-receiving surface that receives the pressure in the first control chamber 291. The cam ring 24 is biased by the above-described hydraulic pressure toward the other side in the direction of the rotation around the pin 27 (which is the counterclockwise direction in FIG. 5 and is the other side that leads to the reduction in the increase/reduction amount of the volume of each of the plurality of vanes 28 and the reduction in Δ). Assume that Fp1 represents a force due to this hydraulic pressure (a hydraulic force). The volume of the first control chamber 291 increases when the cam ring 24 moves toward the above-described other side in the rotational direction (in a direction counteracting the biasing force Fs of the spring 25). The cam ring 24 receives the pressure of the hydraulic oil contained inside the second control chamber 292. The second region 247 of the cam ring outer peripheral surface 245 functions as a second pressure-receiving surface that receives the pressure in the second control chamber 292. The cam ring 24 is biased by the above-described hydraulic pressure toward the above-described one side in the rotational direction. Assume that Fp2 represents a force due to this hydraulic pressure (a hydraulic force). The volume of the second control chamber 292 increases when the cam ring 24 moves toward the above-described one side in the rotational direction (in the same direction as Fs). Fs changes according to a swing amount of the cam ring 24 (a compression amount of the spring 25). The position of the cam ring 24 in the rotational direction (Δ, i.e., the capacity) is determined mainly based on Fp1, Fp2, and Fs. When Fp1 exceeds a sum of Fp2 and Fs (Fp2 +Fs), the cam ring 24 swings toward the above-described other side in the rotational direction, and therefore Δ (the capacity) reduces. When Fp1 falls below (Fp2+Fs), the cam ring 24 swings toward the above-described one side in the rotational direction, and therefore Δ (the capacity) increases. At the position where Fp1 and (Fp2+Fs) are balanced, the cam ring 24 stops.

The hydraulic oil supplied from the discharge port 202 to the main gallery 42 is introduced into the first control chamber 291 via the first feedback passage 431. The pressure in the first control chamber 291 is substantially equal to the hydraulic pressure P1 in the main gallery 42 (provided that a pressure loss is not taken into consideration). The hydraulic oil supplied from the discharge port 202 to the main gallery 42 can be introduced into the second control chamber 292 via the second feedback passage 432 (the supply passage 433, the control valve 7, and the communication passage 435). The hydraulic oil inside the second control chamber 292 can be discharged via the communication passage 435 and the discharge passage 434. Assume that P2 represents the pressure in the second control chamber 292. The control valve 7 can control the introduction of the hydraulic oil into the second control chamber 292 and the discharge of the hydraulic oil from the second control chamber 292. More specifically, the spool 81 switches the connection state between the communication passage 435 and the supply and discharge passages 433 and 434 by moving. The space 804 of the cylinder 80 can function as the passage of the hydraulic oil flowing from the supply passage 433 to the communication passage 435 by connecting the supply ports 803 and the communication ports 805 to each other. The space 807, the holes 815 and 816 of the spool 81, the space 808, the hole 830 of the retainer 83, and the hole 840 of the stopper 84 can function as the passage of the hydraulic oil flowing from the communication passage 435 to the discharge passage 434 by connecting the communication ports 805 and the discharge port 806 to each other. The second land portion 812 changes the opening areas of the communication ports 805 on the inner peripheral surface 800 of the cylinder 80 (the spaces 804 and 807). The connection and the disconnection between the supply passage 433 and the communication passage 435, or the connection and the disconnection between the communication passage 435 and the discharge passage 434 are switched due to the movement of the spool 81. At the time of this switching, basically, the communication passage 435 is brought into communication with any one of the supply passage 433 and the discharge passage 434 and out of communication with the other of them. More specifically, the supply ports 803 are opened to the space 804 regardless of the position of the spool 81. The second land portion 812 causes the communication ports 805 to be opened to the space 804 while closing the openings of the communication ports 805 in the space 807. The second land portion 812 causes the communication ports 805 to be opened to the space 807 while closing the openings of the communication ports 805 in the space 804. The openings of the supply ports 803 in the space 804 may be partially closed according to the movement of the spool 81. The discharge passage 434 does not especially have to be provided, and the discharge port 806 may be directly opened toward the oil pan 400. Further, the discharge port 806 may be arranged in a different manner as long as it is in communication with the low-pressure portion, and may be in communication with not only the oil pan 400 (the atmospheric pressure) but also, for example, the intake inlet side (where a intake negative pressure is generated).

Figure 6:
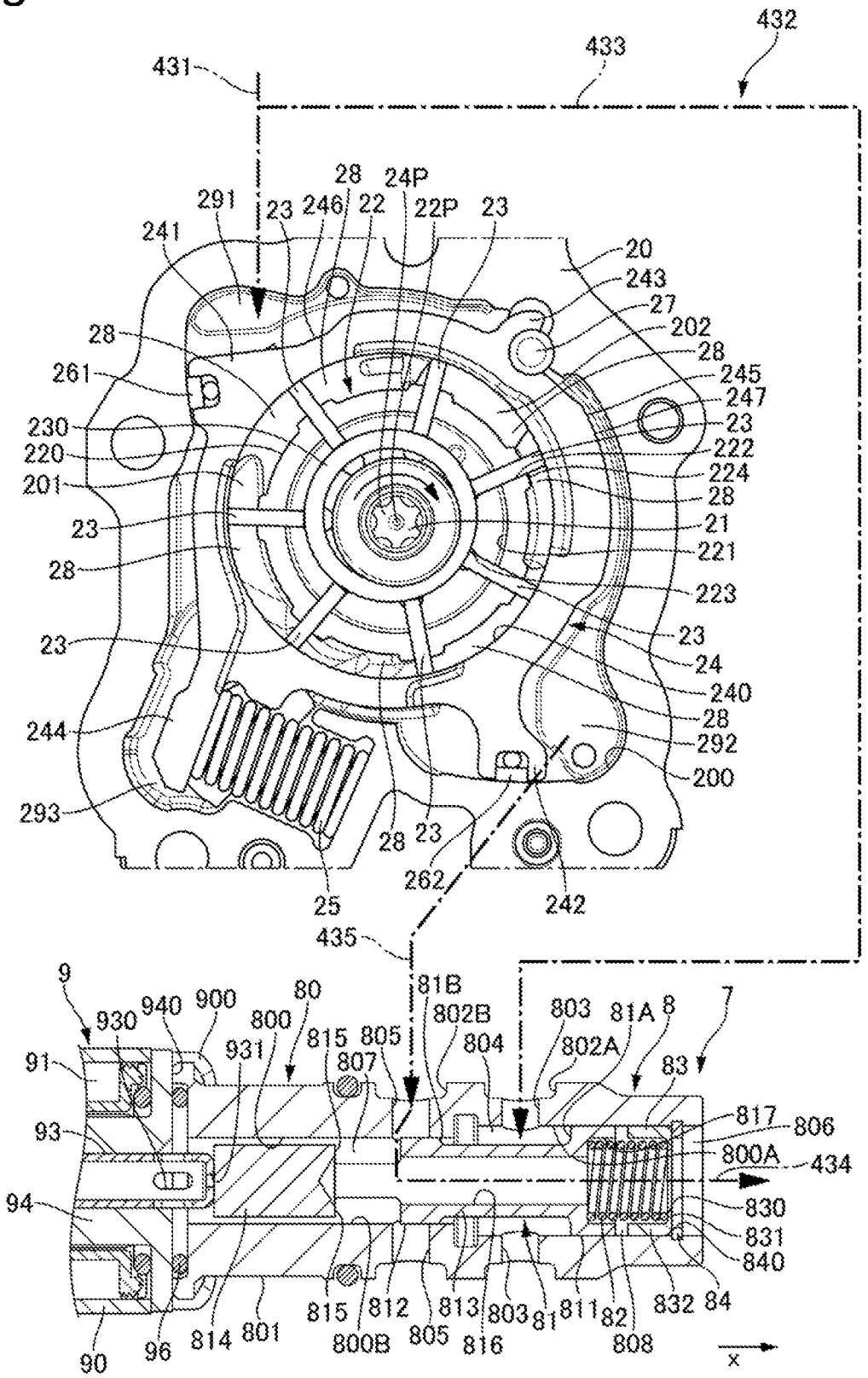
FIG. 6 illustrates an actuation state (a second state) of the pump according to the first embodiment.
Figure 7:
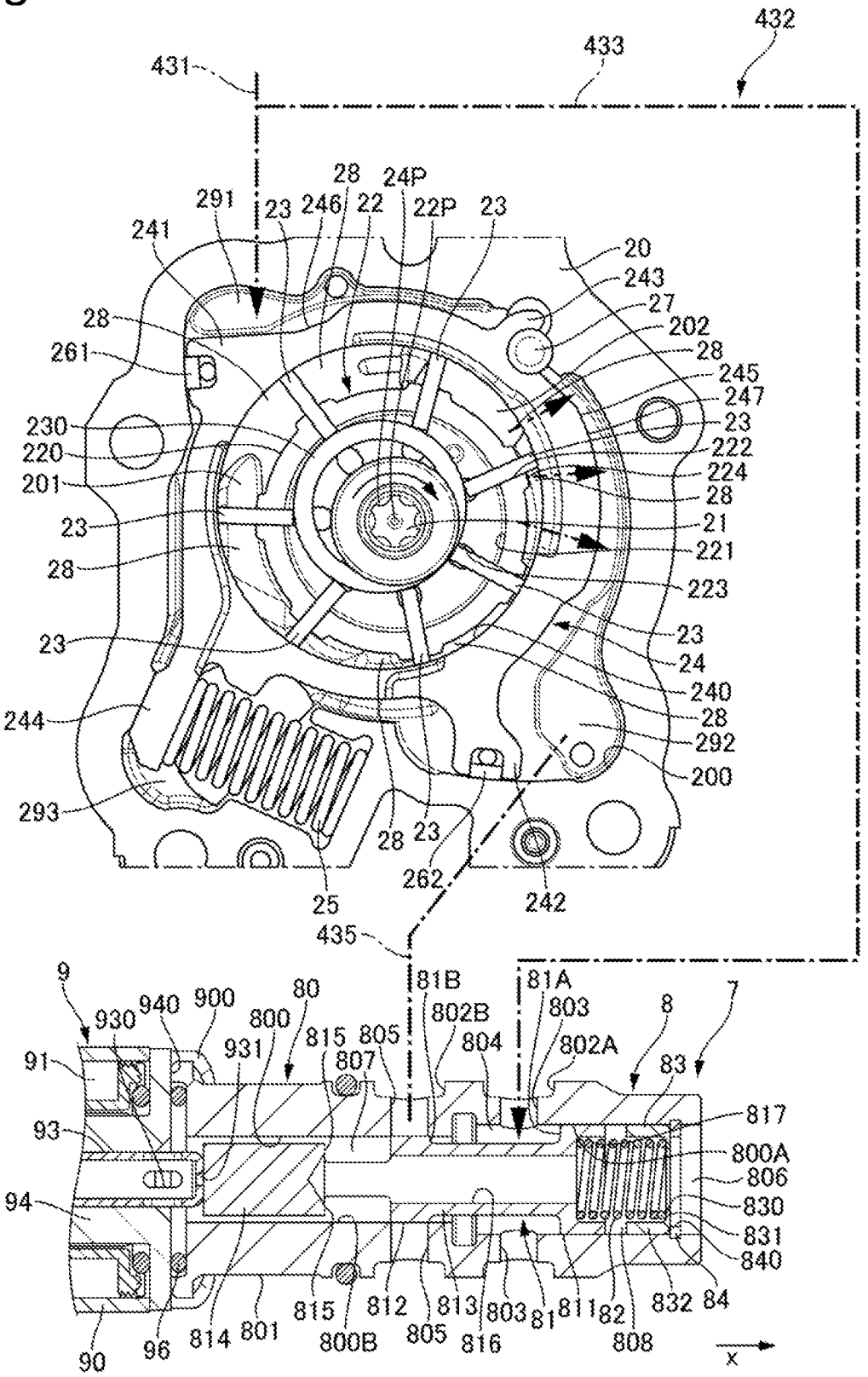
FIG. 7 illustrates an actuation state (a third state) of the pump according to the first embodiment.

In this manner, the spool 81 switches the establishment and the block of the communication between the main gallery 42 and the second control chamber 292 (via the communication passage 435 and the supply passage 433) and also switches the establishment and the block of the communication between the second control chamber 292 and the oil pan 400 (via the communication passage 435 and the discharge passage 434), by switching the connection states of the passages 433 to 435. As illustrated in FIG. 5, when the spool 81 is located at an initial position where the spool 81 is maximumly displaced toward the x-axis negative direction side, the communication passage 435 and the supply passage 433 are connected to each other, and the main gallery 42 and the second control chamber 292 are in communication with each other, so that the hydraulic oil from the discharge port 202 is introduced into the second control chamber 292 (a first state). This state is realized until the spool 81 moves from the initial position toward the x-axis positive direction side by a predetermined distance and the second land portion 812 starts to close the openings of the communication ports 805 in the space 804. As illustrated in FIG. 6, when the spool 81 moves from the initial position toward the x-axis positive direction side by more than the predetermined distance and the second land portion 812 causes the communication ports 805 to be opened to the space 807, the communication passage 435 and the discharge passage 434 are connected to each other. The second control chamber 292 and the oil pan 400 are brought into communication with each other, and the hydraulic oil is discharged from inside the second control chamber 292 (a second state). The second state is prohibited in the first state, and the first state is prohibited in the second state. As illustrated in FIG. 7, when the spool 81 is placed at a predetermined position (a confinement position) located toward the x-axis positive direction side from the initial position, the communication passage 435 is not connected to any of the passages 433 and 434. The second control chamber 292 is brought into a closed state out of communication with both the main gallery 42 and the oil pan 400 (a confinement state), and the hydraulic oil is prohibited from being supplied to the second control chamber 292 and from being discharged from the second control chamber 292 (a third state). In the third state, the opening areas of the communication ports 805 in the space 804 are small compared to the first state. Further, the opening areas of the communication ports 805 in the space 807 are small compared to the second state.

The holes 815 and 816 of the spool 81 function as communication holes establishing the communication between the space 808 on the x-axis positive direction side of the spool 81 (the first land portion 811) and the space 807 on the x-axis negative direction side of the second land portion 812. Therefore, the space 807 and the space 808 have equal pressures to each other (the atmospheric pressure). On the other hand, the space 804 functions as a pressure chamber that generates fp. In other words, the main gallery hydraulic pressure P1 is introduced into the space 804. The stepped portion between the first land portion 811 and the first shaft portion 813 faces the x-axis negative direction side and functions as a first pressure-receiving surface 81A that receives the hydraulic pressure in the space 804. The stepped portion between the second land portion 812 and the first shaft portion 813 functions as a second pressure-receiving surface 81B that faces the x-axis positive direction side and receives the pressure of the hydraulic oil in the space 804. The area of the first pressure-receiving surface 81A is larger than the area of the first pressure-receiving surface 81B. Therefore, when the hydraulic pressure P1 is generated in the space 804, the hydraulic force fp having strength corresponding to an area difference between these surfaces 81A and 81B that is multiplied by P1 is applied to the spool 81 and biases the spool 81 toward the x-axis positive direction side. Further, the spool 81 is biased by the spring 82 toward the x-axis negative direction side. Assume that fs represents this spring force.

Figure 8:
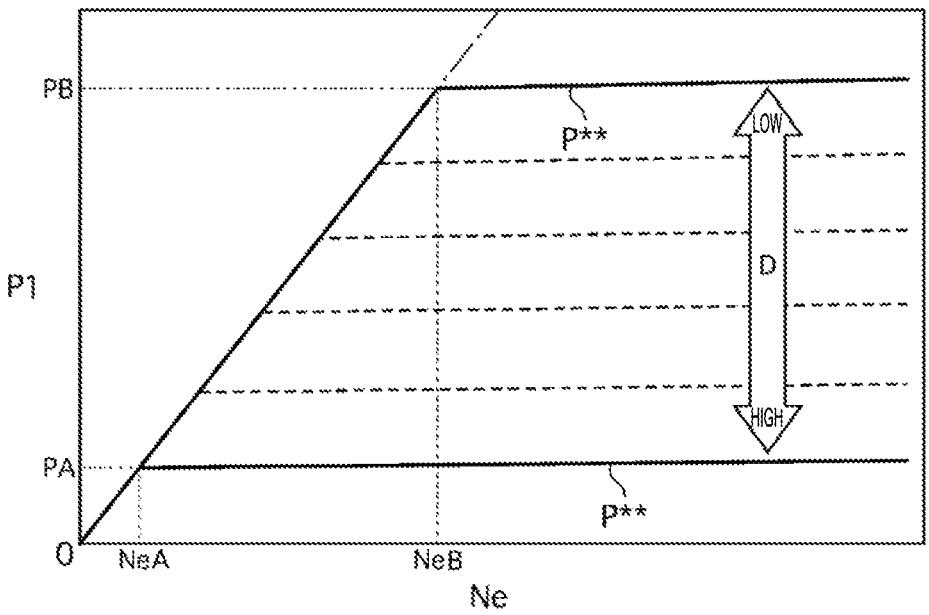
FIG. 8 illustrates a relationship between the number of rotations of the engine and a discharge pressure (a main gallery hydraulic pressure) that is realized by the pump.

Actuation of the control valve 7 and actuation of the cam ring 24 accompanying it when the solenoid thrust force fm is zero (the duty ratio is zero) will be described now. When fm is zero, the position of the spool 81 in the x-axis direction relative to the cylinder 80 is determined mainly based on the hydraulic force fp and the spring force fs. The hydraulic force fp changes according to the main gallery hydraulic pressure P1 (the amount of the hydraulic oil discharged from the pump 2, i.e., the discharge flow rate). The spring force fs changes according to the stroke amount of the spool 81 (the compression amount of the spring 82). The spool 81 moves toward the x-axis positive direction side when fp is stronger than fs, and moves toward the x-axis negative direction side when fp is weaker than fs and is stopped at the position where fp and fs are balanced. When fm is zero, the spool 81 is separated from the rod 93 because the rod 93 is not biased toward the x-axis positive direction side. The hole 931 on the end surface of the rod 93 in the x-axis positive direction facilitates the separation/abutment of the rod 93 from/with the spool 81. In a region of the number Ne of rotations of the engine equal to or lower than a preset value NeB, the number of rotations of the pump 2 is also equal to or lower than a predetermined value (corresponding to NeB), and P1 matches or falls below a predetermined value PB. Since P1 is equal to or lower than PB, fp is equal to or weaker than a predetermined value, and the spool 81 is located within a range separated from the initial position by a predetermined distance toward the x-axis positive direction side. Therefore, the first state is realized. The pressure in the second control chamber 292 increases. Because (Fp2+Fs (the set load of the spring 25)) is stronger than Fp1 applied to the cam ring 24, the cam ring 24 is located at a position where the cam ring 24 maximumly swings toward the one side in the rotational direction and maintains the maximum eccentricity amount Δ. Therefore, as illustrated in FIG. 8, P1 (the discharge flow rate) changes according to Ne at a gradient according to the maximum capacity in the region where Ne is equal to or lower than NeB.

In a region of the number Ne of rotations of the engine higher than the predetermined value NeB, the number of rotations of the pump 2 is also higher than the predetermined value (corresponding to NeB). When the main gallery hydraulic pressure P1 is about to exceed the predetermined value PB, fp exceeds the above-described predetermined value, and the spool 81 moves from the initial position toward the x-axis positive direction side by more than the predetermined distance. At this time, the second state is realized. The pressure in the second control chamber 292 reduces and (Fp2+Fs) applied to the cam ring 24 falls below Fp1, so that the cam ring 24 swings toward the other side in the rotational direction to reduce the eccentricity amount Δ. The reduction in Δ (the capacity) causes a reduction in the discharge flow rate, thereby causing P1 to reduce toward PB. On the other hand, when P1 is about to, fall below PB, the first state is realized again, and the pressure in the second control chamber 292 increases to cause an increase in Fp2 and thus an increase in Δ. The increase in Δ (the capacity) causes an increase in the discharge flow rate, thereby causing P1 to increase toward PB. In this manner, the spool 81 is actuated so as to reduce P1 when P1 increases compared to PB and increase P1 when P1 reduces compared to PB, thereby alternately switching the supply and the discharge of the hydraulic oil to and from the second control chamber 292. In this manner, P1 serves as a pilot pressure and is applied to the spool 81, by which the pump 2 performs feedback control on the actuation state of the spool 81 (the supply and the discharge of the hydraulic oil to and from the second control chamber 292), thereby adjusting Δ (the capacity). As illustrated in FIG. 8, in the region of Ne higher than NeB, P1 is kept at a hydraulic pressure within the predetermined range of PB and around it regardless of Ne. Hereinafter, P1 automatically kept within the predetermined range regardless of Ne will be referred to as a control hydraulic pressure P. The above-described control of P1 is performed by switching the ports 805 of the control valve 7 and the like, and therefore is not affected by the spring constant of the spring 25 of the cam ring 24. Further, the above-described control of P1 is performed within a narrow range of the stroke of the spool 81 regarding the switching of the ports 805 and the like, and is therefore also less affected by the spring constant of the spring 82 of the control valve 7. Therefore, this control can easily achieve a flat characteristic of P with respect to the change in Ne.

The solenoid portion 9 can continuously change the thrust force fm. The solenoid portion 9 functions as a proportional electromagnet capable of controlling fm in a stepless manner according to the value of the supplied current (the duty ratio D). Basically, fm increases when D increases. The change in the value of fm leads to a change in the main gallery hydraulic pressure P1 when the spool 81 is actuated so as to alternately switch the first state and the second state, i.e., the control hydraulic pressure P. In other words, when fm is stronger than zero, the rod 93 contacts the spool 81 and pushes the spool 81 as illustrated in FIGS. 6 and 7. The position of the spool 81 in the x-axis direction relative to the cylinder 80 is determined mainly based on fm, the hydraulic force fp, and the spring force fs. The spool 81 moves toward the x-axis positive direction side when the sum of fm and fp, (fm+fp) is stronger than fs, and moves toward the x-axis negative direction side when (fm+fp) is weaker than fs and is stopped at the position where (fm+fp) and fs are balanced. The solenoid portion 9 has a function of changing P1 when the spool 81 starts to move, i.e., substantially (practically) changing the load fs of the spring 82 by changing fm. The solenoid thrust force fm enhances (assists) fp, and works so as to cause the spool 81 to move toward the x-axis positive direction side to realize the second state with further low P1 (weaker fp). In other words, the solenoid portion 9 reduces P controlled by the above-described actuation of the spool 81. Therefore, as illustrated in FIG. 8, P1 (P) can be controlled to a value lower than PB according to the value of D. As D (i.e., fm) increases, P reduces. As D reduces, P increases. When D is equal to or higher than D2 (fm is a maximum value fmax), P reaches a minimum value PA.

When the engine is in operation, the control program of the ECU 6 is executed, and the control valve 7 is controlled. The ECU 6 can freely change (control) the main gallery hydraulic pressure P1 (the control hydraulic pressure P) and the discharge flow rate by changing the value of the current (the duty ratio D) to supply to the solenoid portion 9 according to the operational state of the engine (the number Ne of rotations of the engine and the like). The ECU 6 can easily adjust P1 with respect to Ne and the characteristic of the discharge flow rate closer to a desired characteristic. As a result, the pump 2 can achieve improvement of the fuel efficiency by preventing a power loss due to an unnecessary increase in the discharge pressure (an increase in the flow rate). The ECU 6 changes D in such a manner that the difference of P1** from a predetermined requested hydraulic pressure P* falls within a predetermined range at arbitrary Ne in a region of Ne higher than a preset value NeA (<NeB). The predetermined requested hydraulic pressure P* is, for example, a hydraulic pressure required to actuate the variable displacement valve apparatus, a requested hydraulic pressure of an oil jet for cooling an engine piston, and a hydraulic pressure required to lubricate a bearing of the crankshaft, and is preset as an ideal value according to Ne and another engine operational state. The ROM of the ECU 6 stores therein P* changing according to Ne, and D changing according to Ne as a map. In the map, D is set to zero when Ne is lower than NeA. When Ne is lower than NeA, no current is supplied to the solenoid portion 9, so that the first state is realized and the eccentricity amount Δ is maximized. Therefore, after the engine actuation is started, the pump 2 can quickly increase P1 according to the increase in Ne, thereby, for example, securing actuation responsiveness of the variable displacement valve apparatus.

In the map, the duty ratio D is set so as to discretely change range by range for each predetermined range of Ne in the region of the number Ne of rotations of the engine that is higher than the predetermined value NeA. In other words, in some range NeI(n−1) of Ne, D is some predetermined value D(n−1) (hereinafter, an index is indicated in parentheses, and n is a natural number). In another range NeI(n) adjacent thereto, D is another predetermined value D(n). In a range NeI* of Ne between NeI(n) and NeI(n−1), D is switched between D(n−1) and D(n). The following description will continue, assuming that D is switched from D(n−1) to D(n) by way of example. When Ne is within NeI*, D is D(n), which is the value after the switching basically (except for during confinement control, which will be described below). As a result, in NeI*, the eccentricity amount Δ (the capacity) is planned to change from the amount for achieving the control hydraulic pressure P(n−1) according to D(n−1) to the amount for achieving P(n) according to D(n) due to the above-described actuation of the control valve 7 (the spool 81). In NeI(n), P(n) is achieved due to a change in Δ with respect to a change in Ne. In other words, the main gallery hydraulic pressure P1 reaches P1=P(n). When Ne changes via a plurality of NeI(n) ranges, the change in P1 in NeI* and P1=P(n) in NeI(n) are repeated a plurality of times, by which a characteristic of P1** changing in a stepwise manner with respect to Ne is achieved. The duty ratio D is preset with respect to Ne in such a manner that this characteristic becomes closer to the characteristic of the requested hydraulic pressure P* with respect to Ne (a predetermined request characteristic). For example, the change in D with respect to Ne in the map is set in such a manner that a difference between P1 in the above-described achieved characteristic and P1 (P*) in the above-described requested characteristic falls within a predetermined range at arbitrary Ne (>NeA).

The ECU 6 performs the confinement control when the duty ratio D is switched between D(n−1) and D(n). The confinement control is control for substantially realizing the third state and increasing the pressure in the second control chamber 292 with use of the hydraulic oil leaking from the discharge port 202 side to the second control chamber 292 at least during a predetermined period while the duty ratio D is switched in the above-described manner. The ECU 6 sets the duty ratio D(s) in the confinement control so as to satisfy the following condition (C1). (C1) Due to the hydraulic force fp derived from the main gallery hydraulic pressure P1 when the confinement control is started and the solenoid thrust force fm according to D(s), the position of the spool 81 (the second land portion 812) is placed so as to be able to sufficiently block the communication between the communication passage 435 and the supply and discharge passages 433 and 434 (substantially realize the third state and be able to increase the pressure in the second control chamber 292 with use of the hydraulic oil leaking from the discharge port 202).

The duty ratio D(s) can be kept constant if the following condition (C2) is satisfied. (C2) During the confinement control, the position of the spool 81 (the second land portion 812) is placed so as to be able to sufficiently block the communication between the communication passage 435 and the supply and discharge passages 433 and 434 regardless of the change in P1 (the change in Fp) (according to the change in the number Ne of rotations of the engine).

When D(s) is kept constant, D(s) can also be kept at D(n), which is the value after the duty ratio D is switched. In this case, the timing of starting the confinement control (for example, Ne when this control is started) is set so as to satisfy the following condition (C3) together with the above-described condition (C2) (with use of an experiment, a simulation, or the like). (C3) When P1 reaches P according to D(n) after the duty ratio is switched or reaches around it, the position of the spool 81 (the second land portion 812) is placed so as to be able to establish the communication between the communication passage 435 and the discharge passage 434** (able to realize the second state).

Next, advantageous effects of the confinement control will be described. When the pump 2 is actuated, air bubbles may be generated in the hydraulic oil sucked into the pump chambers (the vane chambers 28) (aeration due to the suction of air). Further, cavitation may occur in the vane chambers 28. When the inner pressure of the pump (the pressures in the vane chambers 28) is high or when the aeration or the like occurs to significant degree, a pressure difference is generated among the plurality of vane chambers 28 in the discharge region. In the discharge region, the pressure is higher in the vane chamber 28 on one side in the direction of the rotation of the rotor 22 than in the vane chamber 28 on another side in a direction of a reverse rotation of the rotor 22. As a result, the balance is lost in the distribution of the pressures that the cam ring inner peripheral surface 240 receives from the plurality of vane chambers 28 in the discharge region, and the cam ring 24 is biased to the other side in the direction of the rotation around the pin 27 (the counterclockwise direction in FIG. 5 and the like, and the other side that leads to the reduction in the eccentricity amount Δ) regardless of the actuation state of the control valve 7 (i.e., the pressure P2 in the control chamber 292). Therefore, Δ (the capacity) may unintentionally change regardless of the actuation state of the control valve 7. For example, when the number Ne of rotations of the engine increases, the cam ring 24 may swing toward the other side in the rotational direction and Δ (the capacity) may reduce before the main gallery hydraulic pressure P1 increases to the planned control hydraulic pressure P(n). The reduction in the capacity prohibits the discharge flow rate from increasing despite the increase in Ne, thereby prohibiting P1 from increasing to P(n). In this manner, the pressure unbalance among the plurality of vane chambers 28 in the discharge region may make the behavior of the cam ring 24 instable, thereby prohibiting the hydraulic feedback system including the control valve 7 as a component thereof from being actuated as planned, thus leading to a failure to normally achieve the requested hydraulic pressure P*.

Figure 9:
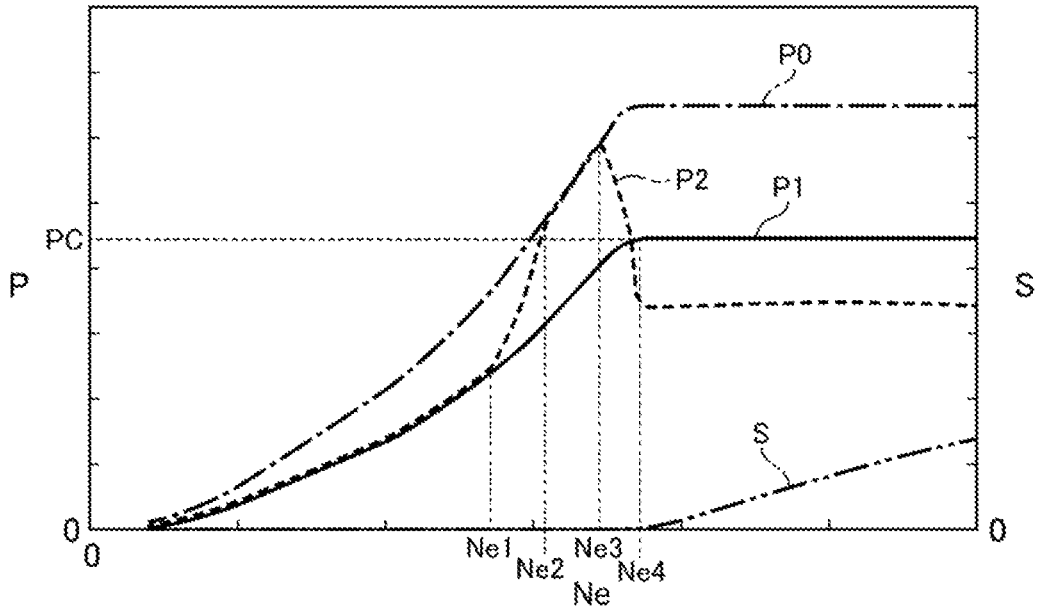
FIG. 9 illustrates one example of a relationship between a hydraulic pressure at each portion and a movement amount of a cam ring, and the number of rotations of the engine that is realized by the pump according to the first embodiment.

Suppose such a situation that the pump 2 increases the main gallery hydraulic pressure P1 from zero to PC according to the increase in the number Ne of rotations of the engine from zero, and keeps it at the predetermined value PC (keeps the control hydraulic pressure P(1) at PC) after that, as illustrated in FIG. 9**. This situation is supposed for the sake of simplification of the description. PC is the requested hydraulic pressure P* between the predetermined value PA and the predetermined value PB and closer to PA (refer to FIG. 8). S represents the movement amount (the stroke) of the cam ring 24 from the initial position. The ECU 6 sets the duty ratio D to zero in the range where Ne is lower than the predetermined value NeA. The ECU 6 switches D between zero and D(1) in the range where Ne is equal to or higher than NeA and lower than Ne4. Basically, the ECU 6 sets D to D(1), which is the value after the duty ratio D is switched. The ECU 6 keeps D at D(1) in a range where Ne is equal to or higher than Ne4. As a result, in the range where Ne is equal to or higher than NeA and lower than Ne4, the eccentricity amount Δ (the capacity) is supposed to change from the amount for achieving the control hydraulic pressure PB according to D=0 to the amount for achieving the control hydraulic pressure PC according to D=D(1) due to the above-described actuation of the control valve 7 (the spool 81). More specifically, (fp+fm) is weaker than the value capable of realizing the second state when P1 is lower than PC (Ne is lower than Ne4). Therefore, it is supposed that the first state is realized with the aid of the control valve 7 and Δ is maximized. In other words, P1 is supposed to change according to Ne at the gradient according to the maximum capacity. Further, it is supposed that the second state is realized with the aid of the control valve 7, and Δ changes and P1=PC is achieved, when P1 reaches PC (Ne reaches Ne4). However, the pressure unbalance among the vane chambers 28 may prohibit P1 from increasing to PC in the situation where Ne (P1) increases, as described above. The cam ring 24 may swing toward the other side in the rotational direction before P1 reaches PC (Ne reaches Ne4), and P1 may stop increasing with respect to the increase in Ne and be kept at a value lower than PC (P**).

To solve this problem, the ECU 6 performs the confinement control (NeA≤Ne1<Ne3) in the range where the number Ne of rotations of the engine falls within the range from Ne1 to Ne3 when switching the duty ratio D. The duty ratio D(s) in the confinement control is set in such a manner that the spool 81 (the second land portion 812) is located slightly closer to the x-axis negative direction side from the confinement position (the third state is substantially realized) when Ne is Ne1 (when the confinement control is started), so as to satisfy the above-described condition (C1). More specifically, D(s) is set so as to generate such fm that the sum (fp+fm) of the hydraulic force fp according to the main gallery hydraulic pressure P1 (the setting value in the map, or may be the detected value) and the solenoid thrust force fm when the Ne is Ne1 is balanced with the "spring force fs when the second land portion 812 completely closes the openings of the communication ports 805 in the space 807 and closes most of the openings of the communication ports 805 in the space 804). Assuming that Ne1 is set in such a manner that D(s) satisfies both the above-described conditions (C2) and (C3), the duty ratio is D(s)=D(1). During the period from Ne1 to Ne4, the ECU 6 generates fm according to D(s)=D(1), and biases the spool 81 with use of this fm.

As a result, when the number Ne of rotations of the engine is Ne1, the communication ports 805 are slightly opened to the space 804 and the communication is established between the second control chamber 292 and the supply passage 433. However, the opening areas of the communication ports 805 in the space 804 fall below those when Ne is lower than Ne1 (before the confinement control is started). In other words, the passage establishing the communication between the second control chamber 292 and the supply passage 433 is narrowed. The spool 81 slightly moves toward the x-axis positive direction side due to a slight increase in the main gallery hydraulic pressure P1 according to the increase in Ne and a slight increase in the hydraulic pressure fp according thereto, in the range where N is Ne1 to Ne3. This is accompanied by an increase in the degree to which the second land portion 812 closes the openings of the communication ports 805 in the space 804 (the degree to which the communication is narrowed in the above-described manner). When Ne reaches Ne3 or around it, the communication ports 805 are slightly opened to the space 807 and the communication is established between the second control chamber 292 and the discharge passage 434. Therefore, the third state is substantially realized in the range where Ne is Ne1 to Ne3. In other words, the confinement state, in which the second control chamber 292 is out of communication with both the main gallery 42 and the oil pan 400, is substantially realized. Due to the slight openings of the communication ports 805 in the spaces 804 and 807, the hydraulic oil can be discharged from the second control chamber 292 to the supply passage 433 or the discharge passage 434 via the communication passage 435, but is discharged by only a limited amount. On the other hand, a slight gap is generated between the surface of the cam ring 24 on the axial side and the bottom surface of the pump containing chamber 200, and the surface of the cover that closes the pump containing chamber 200. The pressure (the inner pressure of the pump) P0 in each of the vane chambers 28 in the discharge region is higher than the pressure P2 in the second control chamber 292. Therefore, the hydraulic oil may be released (leak) from the vane chambers 28 and the discharge port 202 in the discharge region to the second control chamber 292 via the above-described gap. The pressure P2 in the second control chamber 292 substantially brought into the confined state increases due to the above-described leaking hydraulic oil. In other words, the amount of the hydraulic oil leaking from the discharge port 202 and the like into the second control chamber 292 is larger than the amount of the hydraulic oil that may be discharged from the second control chamber 292 due to the slight openings of the communication ports 805 in the spaces 804 and 807. Therefore, P2 can increase. P2 increases toward P0 in the range where Ne is Ne1 to Ne2. P2 reaches P0 when Ne is Ne2, and P2 is kept equal to P0 until Ne reaches Ne3. Fp2 increases due to the increase in P2 toward P0. Therefore, even when the cam ring 24 is biased so as to swing (reduce the eccentricity amount Δ) toward the other side in the rotational direction due to the biasing force derived from the pressure unbalance among the plurality of vane chambers 28 in the discharge region, this swing (the reduction in Δ) is prohibited. Therefore, P1 is not prohibited from increasing toward the predetermined value PC according to the increase in Ne. When Ne is Ne3, P1 reaches around PC.

The second state is realized and the communication is established between the second control chamber 292 and the discharge passage 434 in the range where the number Ne of rotations of the engine is from Ne3 to Ne4. The pressure P2 in the second control chamber 292 reduces from the pump inner pressure P0. When Ne is Ne4, the main gallery hydraulic pressure P1 reaches the predetermined value PC (the control hydraulic pressure P). The spool 81 and the cam ring 24 are actuated so as to keep P1 at PC according to the change in Ne in the range where Ne is equal to or higher than Ne4. After P1 reaches around PC (after the confinement control is ended with Ne equal to or higher than Ne3), the opening areas of the communication ports 805 in the spaces 804 and 807 are (temporally averagely) large compared to during the predetermined period until P1** reaches PC (while Ne falls within the range from Ne1 to Ne3 and the confinement control is in progress). In other words, the passage establishing the communication between the second control chamber 292 and the supply and discharge passages 433 and 434 is not narrowed.

In this manner, the control mechanism 3 can switch the first state or the second state in which the second control chamber 292 is opened to the supply or discharge passage 433 or 34 (the communication passage between the second control chamber 292 and the supply or discharge passage 433 or 434 is not narrowed) and the third state in which the second control chamber 292 is closed to the supply and discharge passages 433 and 434 (the communication passages between the second control chamber 292 and the supply and discharge passages 433 and 434 is narrowed). More specifically, the control mechanism 3 substantially realizes the third state by adjusting the opening areas of the communication ports 805 in the spaces 804 and 807 to (temporally averagely) reduce the above-described opening areas compared to those after P1 reaches P at least during the predetermined period until the main gallery hydraulic pressure P1 reaches the control hydraulic pressure P. The control mechanism 3 can increase the pressure in the second control chamber 292 with use of the hydraulic oil leaking from the discharge port 202 and the like into the second control chamber 292 by performing this confinement control. The load (in the direction for reducing Δ) due to the loss of the pressure balance can be canceled out by increasing the hydraulic force Fp2 due to the pressure P2 in the second control chamber 292 (in the direction for increasing the eccentricity amount Δ). Therefore, the requested hydraulic pressure P* can be further reliably realized by preventing an unexpected actuation of the cam ring 24 (not caused by the actuation of the control valve 7) and thus preventing a failure to reach P. Therefore, the controllability of the pump 2** can be improved. P* can be stably supplied to the engine by preventing insufficiency of the discharge amount due to the unexpected reduction in Δ.

The above-described situation described with reference to FIG. 9 is one example when the above-described conditions (C1), (C2), and (C3) are satisfied. The ECU 6 may also perform similar confinement control not only in a situation where the number Ne of rotations of the engine (the main gallery hydraulic pressure P1) increases but also in a situation where Ne (P1) reduces. The ECU 6 may perform similar confinement control not only in the situation where P1 increases from zero to the predetermined value PC but also in a general situation where P1 is changed from the control hydraulic pressure P(n−1) to P(n) (the duty ratio D is switched between D(n−1) and D(n)). In this case, D(s) may be different from D(n). The ECU 6 may change D(s) so as to hold the spool 81 at or near the confinement position according to the change in P1 (the change in the hydraulic force fp) during the confinement control. The ECU 6 may end the confinement control before the switching of D is ended. For example, the ECU 6 may change D from D(s) to D(n) before Ne reaches NeI(n) if determining that the pressure P2 in the second control chamber 292 sufficiently increases due to the confinement control. Conversely, the ECU 6 may perform the confinement control until the switching of D is ended. In other words, the ECU 6 may keep D at D(s) until the switching of D is ended and change D from D(s) to D(n) when the switching is ended. Alternatively, the ECU 6 may start the confinement control at the same time as the start of the switching of D. In other words, the ECU 6 may change D to D(s) when the switching of D is started. It is sufficient to perform the confinement control in such an engine operational state that the cam ring 24 may malfunction due to the pressure unbalance among the vane chambers 28 from the viewpoint of realizing the further stable control of P1. For example, the ECU 6 detects the engine operational state in which the cam ring 24 may malfunction as described above (the range of Ne or the like), and perform the confinement control only in this state. Alternatively, the ECU 6 may be configured to correct the malfunction by the confinement control only when the cam ring 24 malfunctions as described above actually from the viewpoint of preventing frequent execution of control. For example, the ECU 6 may perform the confinement control upon detecting that P1 stops increasing according to Ne before reaching P(n) in the situation where Ne (P1) increases with use of the pressure sensor 51 or the like. The ECU 6 may use not only Ne but also the number of rotations of the pump, P1, the oil temperature, the water temperature, the engine load, or the like as the parameter for changing the current (D) to supply to the solenoid portion 9** according to the engine operational state.

The mechanical configuration of the pump 2 can be modified in various manners. The configuration of the pump 2 according to the present embodiment can bring about the following advantageous effects. First, the cam ring 24 can swing around the support point (the pin 27) placed inside the pump containing chamber 200. Therefore, the pump 2 can reduce the range where the cam ring 24 is actuated, thereby achieving a reduction in the size of the pump 2.

Further, the volume of the first control chamber 291 increases when the cam ring 24 moves toward the direction for counteracting the biasing force Fs of the spring 25. In other words, the spring 25 generates Fs in the opposite direction from the hydraulic force Fp1, and functions as a return spring. Therefore, the cam ring 24 can be returned to the initial position when Fp1 is zero. The initial position of the cam ring 24 is located on the one side where the eccentricity amount Δ is large. Therefore, P1 can quickly increase when the main gallery hydraulic pressure P1 is low. The volume of the second control chamber 292 increases when the cam ring 24 moves in the same direction as Fs. In other words, Fp2 is applied in the same direction as Fs. Fp1 and Fp2 are applied in the opposite directions from each other. Therefore, the actuation state of the cam ring 24 can be relatively easily controlled by P2 (Fp2). Further, the pump 2 can actuate the cam ring 24 in the direction for increasing with low Fs, thereby reducing the set load of the spring 25. Therefore, the pump 2 can actuate the cam ring 24 in the direction for reducing Δ with low Fp1. This means that the pump 2 can reduce P1 when the cam ring 24 is actuated in the direction for reducing Δ. In other words, the pump 2 can realize the low control hydraulic pressure P**.

The hydraulic oil may be directly introduced from the discharge port 202 into the first control chamber 291 without being introduced via the main galley 42. The hydraulic oil is introduced into the second control chamber 292 via the supply passage 433. The supply passage 433 (at least a part thereof) is placed outside the housing of the pump 2. Due to the pressure loss in the supply passage 433, the pressure P2 in the second control chamber 292 falls below the pressure in the discharge port 202, i.e., the pressure P0 in each of the vane chambers 28 (the inner pressure of the pump) in the discharge region even when being maximized (the main gallery hydraulic pressure P1). When P2 is lower than P0, the cam ring 24 easily swings toward the other side in the rotational direction due to the biasing force derived from the pressure unbalance among the plurality of vane chambers 28 in the discharge region. Further, in the third state, the hydraulic oil easily leaks from the discharge port 202 and the like into the second control chamber 292 by passing through the gap between the surface of the cam ring 24 on the axial side and the bottom surface of the pump containing chamber 200 and the like. For this reason, the confinement control works well.

The area of the second region 247 that receives the pressure P2 in the second control chamber 292 on the cam ring outer peripheral surface 245 may be equal to the area of the first region 246 that receives the pressure P1 in the first control chamber 291 or may be smaller than the area of the first region 246. In the present embodiment, the area of the second region 247 is larger than the area of the first region 246. Therefore, the strong hydraulic force Fp2 can be realized with low P2. For example, Fp2 is stronger than the hydraulic force Fp1 even when P1 and P2 are equal to each other. Therefore, the pump 2 can prevent the cam ring 24 from having an unstable behavior by biasing the cam ring 24 in the direction for increasing the eccentricity amount Δ even if the balance is somewhat disturbed among the pressures applied from the vane chambers 28 to the cam ring 24 in the discharge region. Now, if the control mechanism 3 controls P2 to lower than P1 when keeping the main gallery hydraulic pressure P1 at the control hydraulic pressure P by switching the first state and the second state, this leads to an increase in the pressure difference (P0–P2) between the second control chamber 292 and the discharge port 202. Therefore, the hydraulic oil may leak as described above by a larger amount. To eliminate this risk, the radial width of the cam ring 24 is wider in the second region 247 than in the first region 246. Therefore, the sealability can be improved on the second control chamber 292 side, which contributes to preventing the above-described leak, thereby being able to improve the efficiency of the pump 2. P1 is constantly introduced into the first control chamber 291, and the pressure difference (P0–P1) is relatively small between the first control chamber 291 and the discharge port 202. Therefore, a wasteful increase in the weight of the cam ring 24 can be prevented by improving the sealability (increasing the above-described radial width) only on the second control chamber 292** side.

The structure of the valve portion 8 of the control valve 7 may be a puppet-type structure or a slide-type structure. In the present embodiment, the above-described structure is a spool-type structure. Therefore, the pump 2 can bring about an effect of, for example, allowing the multi-port valve to simplify the structure thereof while supporting a wide range of hydraulic pressures. More specifically, the cylinder 80 includes the supply ports 803, the communication ports 805, and the discharge port 806. The supply ports 803 are connected to the supply passage 433, and can introduce the hydraulic oil supplied from the discharge port 202 to the main gallery 42 into the cylinder 80. The communication ports 805 are connected to the second control chamber 292, and establish the communication between inside the cylinder 80 and the second control chamber 292. The discharge port 806 is connected to the discharge passage 434, and can discharge the hydraulic oil from inside the cylinder 80. The spool 81 includes the second land portion 812 capable of changing the opening areas of the communication ports 805 on the inner peripheral surface 800 of the cylinder 80. The spool 81 is reciprocable in the x-axis direction inside the cylinder 80, and receives the pressure P1 of the hydraulic oil introduced from the supply ports 803 into the cylinder 80. With such a simple structure of the spool vale, the valve portion 8 can control the pressure P2 in the second control chamber 292.

The spool 81 is biased by the main gallery hydraulic pressure P1 (the hydraulic force fp) toward the x-axis positive direction side. Further, the spool 81 is biased by the spring 82 (the spring force fs) toward the x-axis negative direction side. In other words, the spring 82 acts in the opposite direction from fp and functions as a return spring, and therefore the spool 81 can be returned to the initial position when fp is zero. The initial position of the spool 81 is located in the direction for realizing the first state, i.e., the direction for increasing the pressure in the second control chamber 292 to increase the eccentricity amount Δ. Therefore, P1 can quickly increase when P1 is low.

The control valve 7 includes the solenoid portion 9. The solenoid portion 9 can generate the electromagnetic force fm for controlling the position of the valve body (the position of the spool 81 in the x-axis direction). Therefore, the pump 2 can easily control the spool 81 to or around the confinement position, thereby easily performing the confinement control. The solenoid portion 9 can change the value of fm according to the duty ration D. Therefore, the pump 2 can freely control the spool 81 to or around the confinement position. The method for transmitting the force from the plunger 92 to the valve body (the spool 81) may be a pilot-type method (an indirect actuation method). In the present embodiment, the above-described method is a direct acting-type method (a direct actuation method). More specifically, the solenoid portion 9 can generate fm directly biasing the spool 81. The pump 2 can further easily perform the confinement control by controlling the spool 81 to or around the confinement position without intervention of the hydraulic pressure (the pilot valve). The member (the rod 93) used for the solenoid portion 9 to bias the spool 81 may be integrated with the spool 81. In the present embodiment, the rod 93 is prepared as a different member from the spool 81, and is separable from the spool 81. Therefore, even at the time of such a failure that the solenoid portion 9 becomes unable to be actuated due to disconnection or the like, the valve portion 8 can be automatically actuated according to the main gallery hydraulic pressure P1. As a result, the pump 2 can realize the predetermined control hydraulic pressure P**.

The solenoid portion 9 may be able to generate the electromagnetic force fm biasing the spool 81 toward the x-axis negative direction side, i.e., the same direction as the spring 82 (the spring force fs). In the present embodiment, the solenoid portion 9 can generate fm biasing the spool 81 toward the x-axis positive direction side. i.e., the direction same as the main gallery hydraulic pressure P1 (the direction for assisting the hydraulic force fp) and opposite from the spring 82 (the direction for diminishing fs). As a result, a fail-safe function can be realized. In other words, as illustrated in FIG. 8, the control hydraulic pressure P increases as the duty ratio D (fm) reduces, and P reaches the highest value PB when D is zero. Therefore, even when a failure has occurred in the solenoid portion 9, the pump 2 can increase P** and supply the hydraulic oil to the engine with the maximum pressure PB, thereby being able to prevent an engine seizure or the like due to a lubrication failure.

The dimension of the second land portion 812 in the x-axis direction may be larger or may be smaller than the diameters (the dimensions in the x-axis direction) of the openings of the communication ports 805. In other words, the communication ports 805 overlapping the second land portion 812 may be slightly opened to both the spaces 804 and 807 or may be closed to the spaces 804 and 807 when the spool 81 is located in the predetermined range in the x-axis direction. In the present embodiment, the dimension of the second land portion 812 in the x-axis direction is substantially equal to the diameters (the dimensions in the x-axis direction) of the openings of the communication ports 805. Therefore, the establishment and the block of the communication between the communication ports 805 and the spaces 804 and 807 is quickly switched according to the movement of the spool 81. Therefore, the pump 2 can improve the control responsiveness. On the other hand, the second state is prohibited in the first state, and the first state is prohibited in the second state. Therefore, the pump 2 can improve the control responsiveness, and also further easily realize the third state (the confinement state).

The shapes of the openings of the communication ports 805 and the like on the inner peripheral surface 800 of the cylinder 80 may be such a rectangle, an ellipse, or the like that the dimensions of the above-described openings in the circumferential direction of the cylinder 80 (the direction around the central axis) are larger than the dimensions of the above-described openings in the axial direction of the cylinder 80 (the x-axis direction). In the present embodiment, the shapes of the above-described openings of the communication ports 805 are circular. More specifically, the dimensions of the above-described openings in the circumferential direction of the cylinder 80 are close to zero near the ends of the above-described openings in the axial direction of the cylinder 80 and gradually increase toward the centers of the above-described openings in the axial direction of the cylinder 80, but a rate of this change is relatively low. This contributes to preventing a sudden change in the opening areas of the communication ports 805 in the spaces 804 and 807 according to the movement of the spool 81. The effect of the narrowed passage makes gentle the change in the flow rate of the hydraulic oil flowing from the space 804 into the second control chamber 292 via the communication ports 805, and the change in the flow rate of the hydraulic oil flowing from the second control chamber 292 into the space 807 via the communication ports 805 according to the movement of the spool 81. Because of the reduction in the change in the pressure P2 in the second control chamber 292, the pump 2 stabilizes the behavior of the spool 81 and the cam ring 24, thereby reducing the change in the main gallery hydraulic pressure P1.

The area of the first pressure-receiving surface 81A of the spool 81 is larger than the area of the second pressure-receiving surface 81B. Due to the presence of the pressure difference between these pressure-receiving surfaces 81A and 81B, the pump 2 can generate the hydraulic force fp biasing the spool 81 toward the x-axis direction side with the single pressure P1. Because not having to apply a plurality of pressures to the spool 81 for generating fp, the control valve 7 can be simply structured. The first pressure-receiving surface 81A and the second pressure-receiving surface 81B face each other in the x-axis direction, and define the space 804 into which the hydraulic oil is introduced from the discharge port 202 together with the inner peripheral surface 800 of the cylinder 80. Therefore, it is sufficient to prepare the single space 804 for generating fp, and therefore the control valve 7 can be simply structured. Further, the space 804 for generating fp is located at the intermediate portion of the spool 81 in the x-axis direction and is not located at the end portion of the spool 81 in the x-axis direction. Therefore, the control valve 7 can be prevented from increasing in dimension in the x-axis direction.

Second Embodiment

Figure 10:
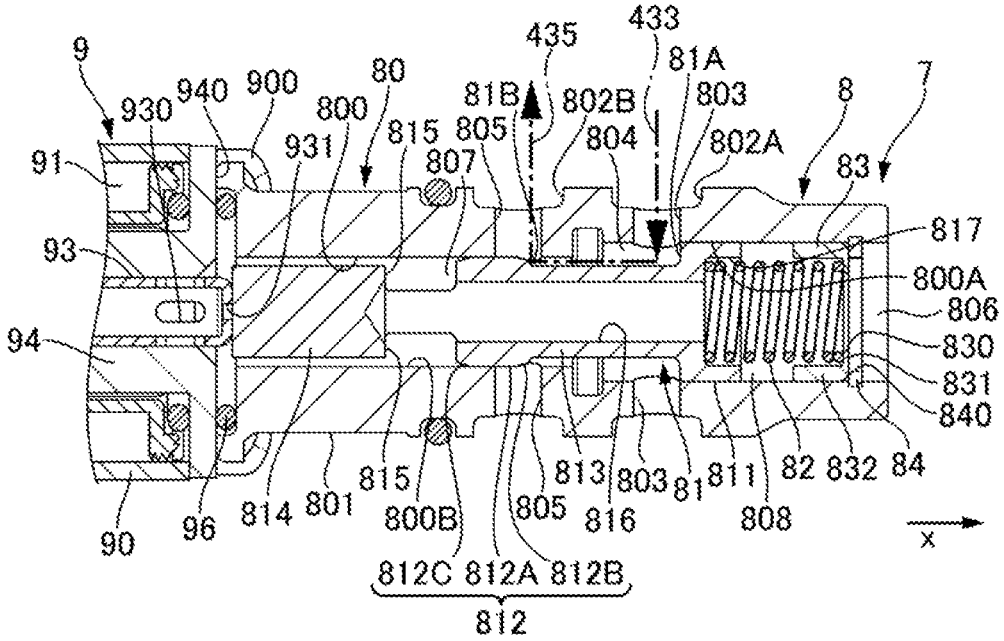
FIG. 10 is a cross-sectional view passing through a central axis of a control valve according to a second embodiment (a spool is located at an initial position).
Figure 11:
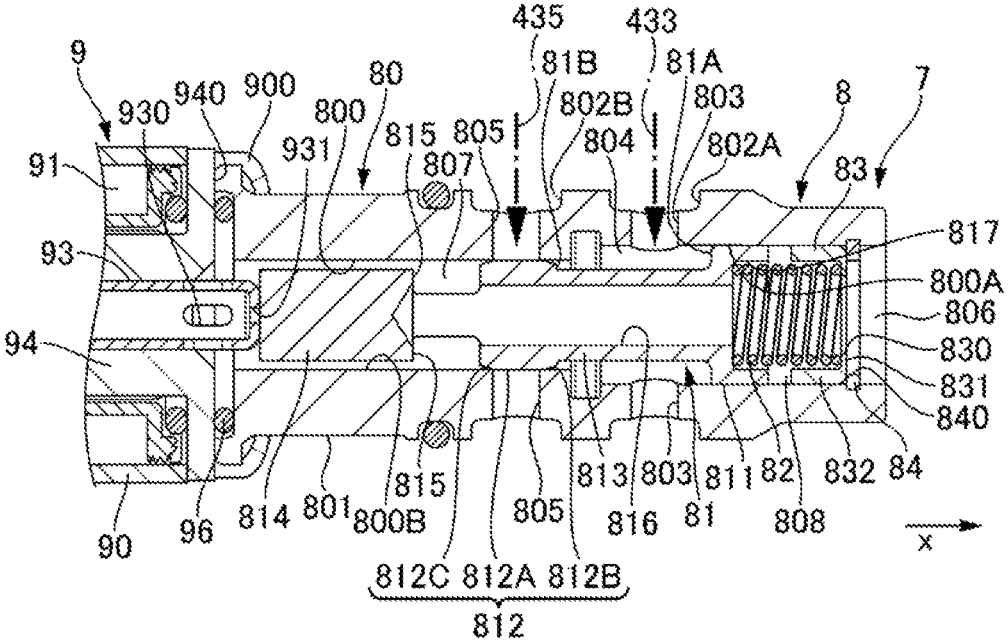
FIG. 11 is a cross-sectional view passing through the central axis of the control valve according to the second embodiment (the spool is located at a confinement position).

First, a configuration will be described. The second embodiment is different from the first embodiment only in terms of the configuration of the control valve 7. As illustrated in FIG. 10, the dimension of the second land portion 812 of the spool 81 in the x-axis direction is larger than the diameters (the dimensions in the x-axis direction) of the openings of the communication ports 805 on the inner peripheral surface 800 of the cylinder 80. The both sides of the second land portion 812 in the x-axis direction are tapered. The second land portion 812 includes a main body portion 812A, an end portion 812B on the x-axis positive direction side, and an end portion 812C on the x-axis negative direction side. The main body portion 812A is columnar. The dimension of the main body portion 812A in the x-axis direction is equal to the dimension of the second land portion 812 (the communication ports 805) according to the first embodiment in the x-axis direction. The shape of each of the end portions 812B and 812C is a circular truncated cone-like shape. The diameter of each of the end portions 812B and 812C is smaller than the main body portion 812A, and gradually reduces according to an increase in the distance from the main body portion 812A in the x-axis direction. An outer peripheral surface of the end portion 812B is shaped like being cut out entirely in the circumferential direction (the direction around the central axis of the spool 81), and is tapered in such a manner that the diameter thereof is reducing toward the x-axis positive direction side. Similarly, an outer peripheral surface of the end portion 812C is shaped like being cut out entirely in the circumferential direction, and is tapered in such a manner that the diameter thereof is reducing toward the x-axis negative direction side. When the spool 81 is located at the initial position, the main body portion 812A is located at the same position as the second land portion 812 when the spool 81 is located at the initial position in the first embodiment. The end portion 812B is provided between the ends of the communication ports 805 on the x-axis positive direction side and the ends thereof on the x-axis negative direction side in the x-axis direction. As illustrated in FIG. 11, when the spool 81 is located at the confinement position, the main body portion 812A is located at the same position as the second land portion 812 when the spool 81 is located at the confinement position in the first embodiment. The other configuration is similar to the first embodiment, and therefore corresponding components will be identified by the same reference numerals and will not be redundantly described below.

Next, advantageous effects will be described. The dimension of the second land portion 812 in the x-axis direction is larger than the dimensions of the openings of the communication ports 805 in the x-axis direction. Therefore, the pump 2 can prevent the communication between the communication ports 805 and the spaces 804 and 807 from being excessively frequently switched between the establishment and the block when the spool 81 moves due to the change in the hydraulic force Fp1 and the first state and the second state are switched. Further, the pump 2 can also substantially prevent the communication passage 435 from being connected to any of the communication passages 433 and 434 due to the outer peripheral surfaces of the end portions 812B and 812C facing the above-described openings of the communication ports 805 when the spool 81 is located near the confinement position (the main body portion 812A is slightly offset from the above-described openings of the communication ports 805 in the x-axis directions). Therefore, the pump 2 can further easily realize the third state, and further easily perform the confinement control.

When the spool 81 slightly moves from the confinement position in the x-axis direction, a small gap is generated between the outer peripheral surface of the end portion 812B or the end portion 812C and the edges of the openings of the communication ports 805 on the inner peripheral surface 800 of the cylinder 80. A gap between the outer peripheral surface of the end portion 812B or 8120 and the inner peripheral surface 800 of the cylinder 80 including this gap can function as a flow passage of the hydraulic oil between the space 804 or the space 807 and the communication ports 805. When the communication is established between the space 804 or 807 and the communication ports 805 according to the movement of the spool 81, the hydraulic oil flows via the above-described flow passage. Therefore, the effect of the narrowed passage makes gentle the change in the flow rate of the hydraulic oil flowing from the space 804 into the second control chamber 292 via the communication ports 805, and the change in the flow rate of the hydraulic oil flowing from the second control chamber 292 into the space 807 via the communication ports 805 (discharged via the holes 815 and 816) according to the movement of the spool 81. The behavior of the cam ring 24 is stabilized because the change in the pressure P2 in the second control chamber 292 is reduced when the first to third states are switched. Further, the behavior of the spool 81 is stabilized because the change in the pressure in the space 804 (which generates the hydraulic force Fp1) is reduced. Therefore, the change in the main gallery hydraulic pressure P1 is reduced.

The size of the gap between the outer peripheral surface of the end portion 812B or 812C and the inner peripheral surface 800 of the cylinder 80 corresponds to the flow passage cross-sectional area of the above-described flow passage, and increases according to an increase in the distance from the main body portion 812A in the x-axis direction. This configuration can further effectively make gentle the above-described change in the flow rate. The present advantageous effects can be achieved only by including the above-described flow passage on the spool 81 (the second land portion 812) at least partially in the circumferential direction. In the present embodiment, the outer peripheral surfaces of the end portions 812B and 812C are shaped like being cut out entirely in the circumferential direction. In the other words, the above-described flow passage extends along the entire range of the spool 81 (the second land portion 812) in the circumferential direction. Therefore, the pump 2 can improve the accuracy of the processing on the outer peripheral surfaces of the end portions 812B and 812C, thereby enhancing the above-described advantageous effects. Further, because the position of the above-described flow passage (gap) and the positions of the above-described openings of the communication ports 805 do not have to be aligned with each other in the circumferential direction, the spool 81 can be mounted on the cylinder 80 with improved mountability. Other advantageous effects are similar to the first embodiment.

Third Embodiment

Figure 12:
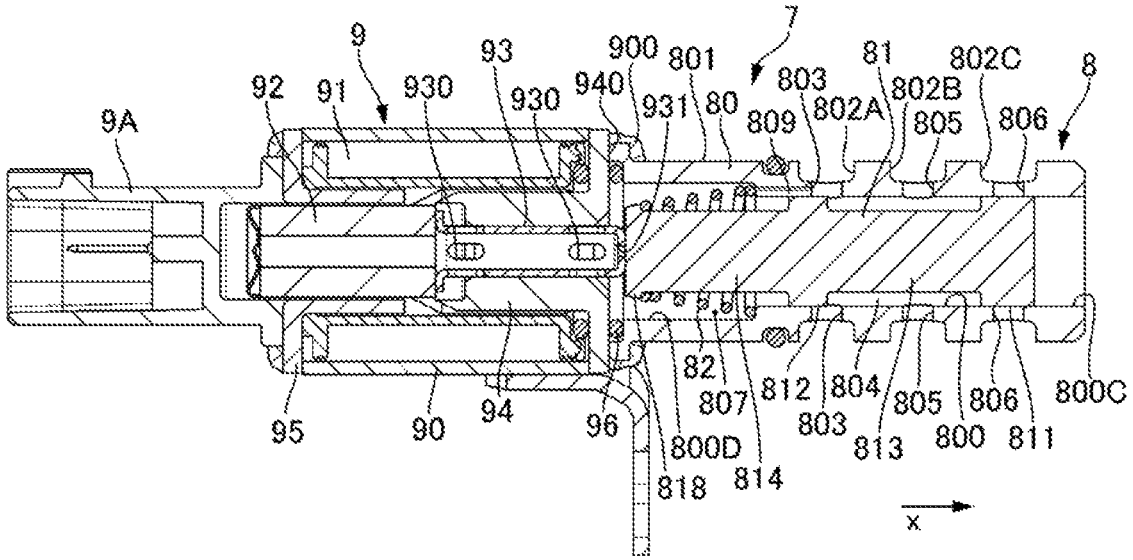
FIG. 12 is a cross-sectional view passing through a central axis of a control valve according to a third embodiment (the spool is located at the initial position).

First, a configuration will be described. The third embodiment is different from the first embodiment only in terms of the configuration of the control valve 7. As illustrated in FIG. 12, the inner peripheral surface 800 of the cylinder 80 includes a main body portion 800C and a large diameter portion 800D. The diameter of the large diameter portion 800D is larger than the diameter of the main body portion 800C. The main body portion 800C is located on the x-axis positive direction side, and the large diameter portion 800D is located on the x-axis negative direction side. Annular grooves 802A, 802B, and 802C are provided on the outer peripheral surface 801 of the cylinder 80. The annular grooves 802A, 802B, and 802C are arranged in this order from the x-axis negative direction side toward the x-axis positive direction side. The supply ports 803, the communication ports 805, and the discharge port 806 are holes radially penetrating through the cylinder 80, and are opened to the annular grooves 802A, 802B, and 802C, respectively, and are also opened to the main body portion 800C. A plurality of discharge ports 806 is provided in the circumferential direction of the cylinder 80. The one end of the discharge passage 434 is connected to the annular groove 802C (the discharge ports 806). A groove 809 is provided at the end of the main body portion 800C on the x-axis negative direction side. The groove 809 extends in the x-axis direction, and connects the supply ports 803 and the large diameter portion 800D to each other. One or more grooves 809 are provided in the circumferential direction of the cylinder 80.

The diameters of the first land portion 811 and the second land portion 812 of the spool 81 are equal to each other, and are slightly smaller than the diameter of the main body portion 800C. In the x-axis direction, the distance between the end of the first land portion 811 on the x-axis negative direction side and the end of the second land portion 812 on the x-axis positive direction side is substantially equal to the distance between the ends of the supply ports 803 (the opening portions thereof to the main body portion 800C) on the x-axis positive direction side and the ends of the discharge ports 806 (the opening portions thereof to the main body portion 800C) on the x-axis negative direction side. The distance between the end of the first land portion 811 on the x-axis negative direction side and the end of the second land portion 812 on the x-axis positive direction side may be set in a different manner as long as it is longer than the distance between the ends of the supply ports 803 on the x-axis positive direction side and the ends of the communication ports 805 on the x-axis negative direction side and is longer than the distance between the ends of the discharge ports 806 on the x-axis negative direction side and the ends of the communication ports 805 on the x-axis positive direction side, and may be shorter than the distance between the ends of the supply ports 803 on the x-axis positive direction side and the ends of the discharge ports 806 on the x-axis negative direction side. The holes 815 and 816, like the first embodiment, are not provided inside the spool 81. A flange portion 818 is provided at the end of the second shaft portion 814 on the x-axis negative direction side. Both the land portions 811 and 812 are in sliding contact with the main body portion 800C.

The space 804 is cylindrical, and the communication ports 805 are constantly opened thereto and the supply ports 803 are opened thereto in the initial state. The discharge ports 806 can be opened to the space 804. The space 807 has a stepped cylindrical shape, and is defined by the stepped portion between the second land portion 812 and the second shaft portion 814, the outer peripheral surface of the second shaft portion 814 and the end surface thereon on the x-axis negative direction, the inner peripheral surfaces 800C and 800D of the cylinder 80, and the surface 940 of the fixed iron core 94 on the x-axis positive direction side. The groove 809 is constantly opened to the space 807. The space 807 is constantly in communication with the supply ports 803 via the groove 809. The valve portion 8 does not include the retainer 83 and the stopper 84 like the first embodiment. The spring 82 has such a circular truncated cone-like shape that the diameter thereof is gradually reducing from one axial side (an x-axis positive direction side) thereof toward the other axial side (an x-axis negative direction side) thereof, and is mounted in the space 807. The end portion of the spring 82 on the large diameter side (the x-axis positive direction side) is in contact with the stepped portion between the main body portion 800C and the large diameter portion 800D on the inner peripheral surface 800 of the cylinder 80. The end portion of the spring 82 on the small diameter side (the x-axis negative direction side) is in contact with the surface of the flange portion 818 of the spool 81 on the x-axis positive direction side. The spring 82 is kept in a compressed state and has a predetermined set load in the initial state, thereby constantly biasing the spool 81 toward the x-axis negative direction side. The other configuration is similar to the first embodiment, and therefore corresponding components will be identified by the same reference numerals and will not be redundantly described below.

Figure 13:
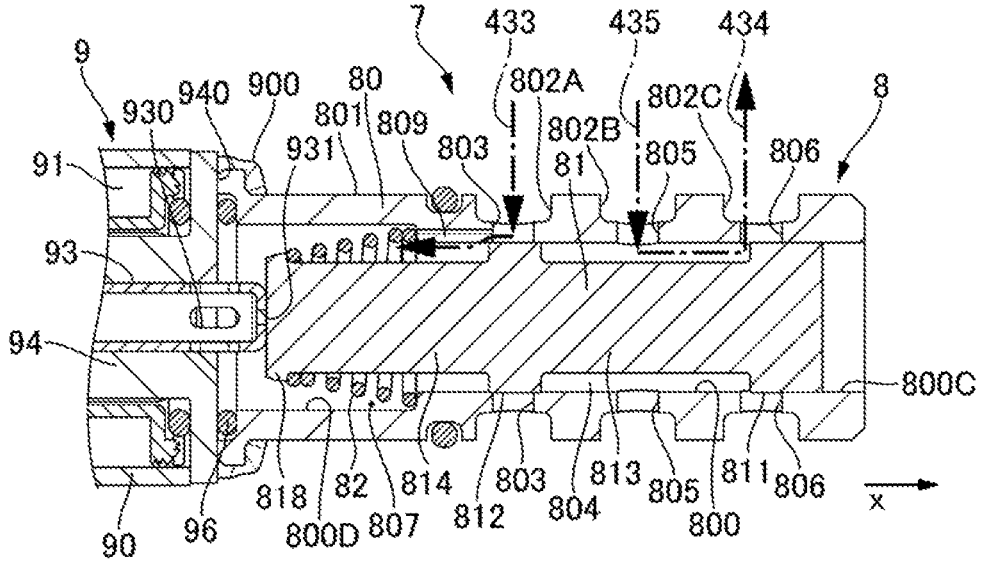
FIG. 13 is a cross-sectional view passing through the central axis of the control valve according to the third embodiment (the spool moves by a large amount).
Figure 14:
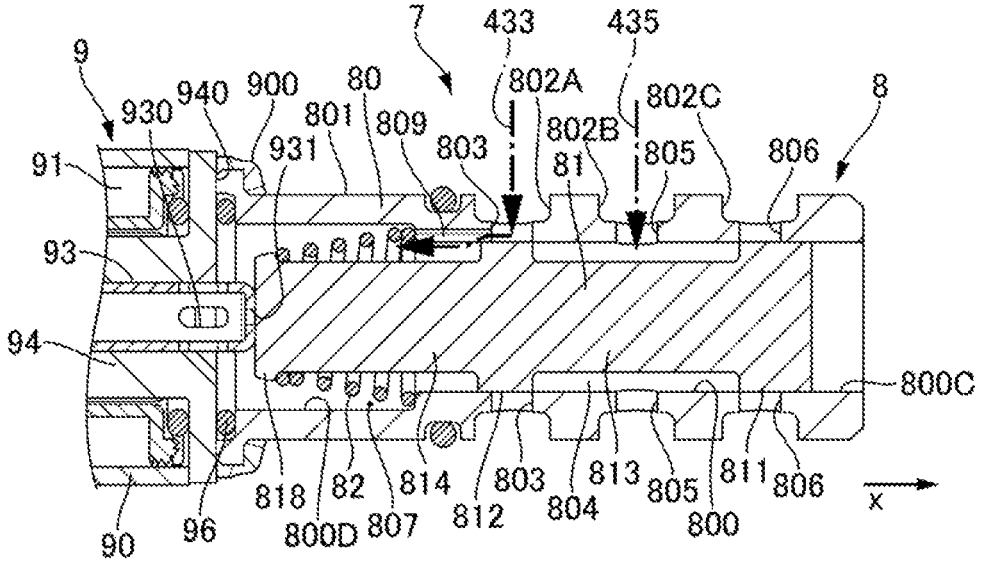
FIG. 14 is a cross-sectional view passing through the central axis of the control valve according to the third embodiment (the spool is located at the confinement position).

Next, advantageous effects will be described. The space 804 of the cylinder 80 can function as the passage of the hydraulic oil flowing from the supply passage 435 to the discharge passage 434 by connecting the supply ports 805 and the communication ports 806 to each other. The first land portion 811 causes changes in the opening areas of the discharge ports 806 on the inner peripheral surface 800 of the cylinder 80 (the space 804). The second land portion 812 causes changes in the opening areas of the supply ports 803 on the inner peripheral surface 800 of the cylinder 80 (the space 804). The communication ports 805 are opened to the space 804 regardless of the position of the spool 81. The second land portion 812 causes the supply ports 803 to be opened to the space 804 with the first land portion 811 closing the openings of the discharge ports 806 in the space 804. The second land portion 812 closes the openings of the supply ports 803 in the space 804 with the first land portion 811 opening the discharge ports 806 in the space 804. As illustrated in FIG. 12, when the spool 81 is located at the initial position, the communication ports 805 (the communication passage 435) and the supply ports 803 (the supply passage 433) are connected to each other, and the first state is realized. As illustrated in FIG. 13, when the spool 81 moves by more than the predetermined distance from the initial position toward the x-axis positive direction side and the first land portion 811 causes the discharge ports 806 to be opened to the space 804, the communication passage 435 and the discharge passage 434 are connected to each other, and the second state is realized. As illustrated in FIG. 14, when the spool 81 is located at the predetermined position (the confinement position) on the x-axis positive direction side from the initial position, the third state is realized. In the third state, the opening areas of the supply ports 803 in the space 804 are small compared to in the first state. Further, the opening areas of the discharge ports 806 in the space 804 are small compared to in the second state.

The hydraulic oil from the discharge port 202 (the main gallery hydraulic pressure P1) is introduced into the space 807 via the groove 809. On the spool 81, the stepped portion between the second land portion 812 and the second shaft portion 814 and the end surface of the second shaft portion 814 on the x-axis negative direction face the x-axis negative direction side, and function as the pressure-receiving surface that receives the pressure of the hydraulic oil in the space 807. This pressure-receiving surface defines the space 807 together with the surface 940 fixed to the cylinder 80 and facing the x-axis positive direction side, and the inner peripheral surface 800 of the cylinder 80. The space 807 functions as the pressure chamber that generates the hydraulic force fp. Therefore, because it is sufficient to apply the hydraulic pressure to the pool 81 from a single direction (onto a single pressure-receiving surface) for generating fp, the spool 81 can be simply structured. The space 807 also functions as the spring chamber that contains the spring 82. Therefore, the control valve 7 can be prevented from increasing in dimension in the x-axis direction. Other advantageous effects are similar to the first embodiment.

Fourth Embodiment

Figure 15:
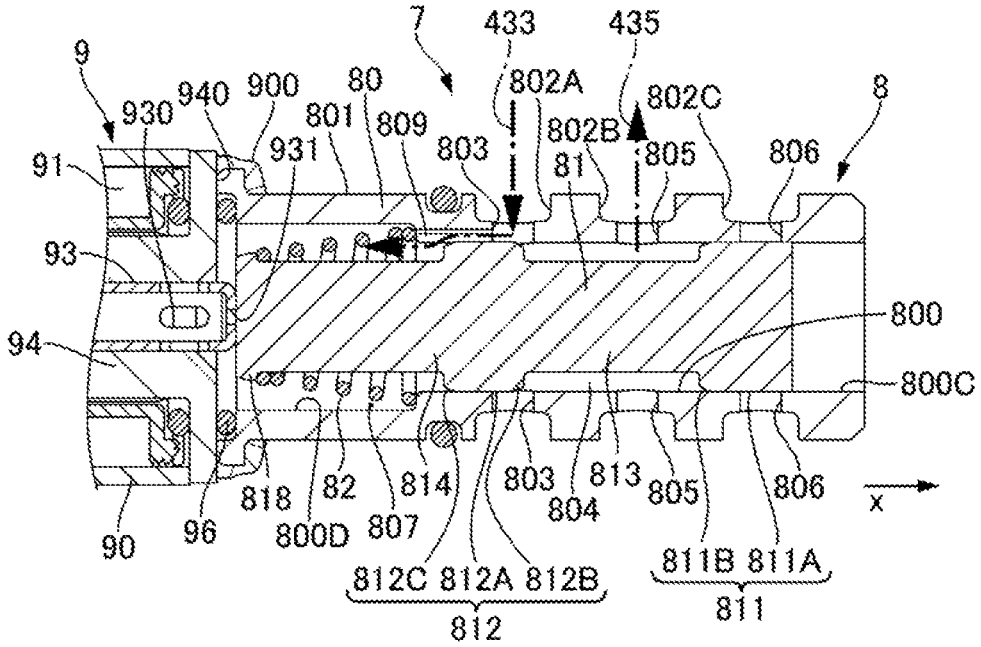
FIG. 15 is a cross-sectional view passing through a central axis of a control valve according to a fourth embodiment (the spool is located at the initial position).
Figure 16:
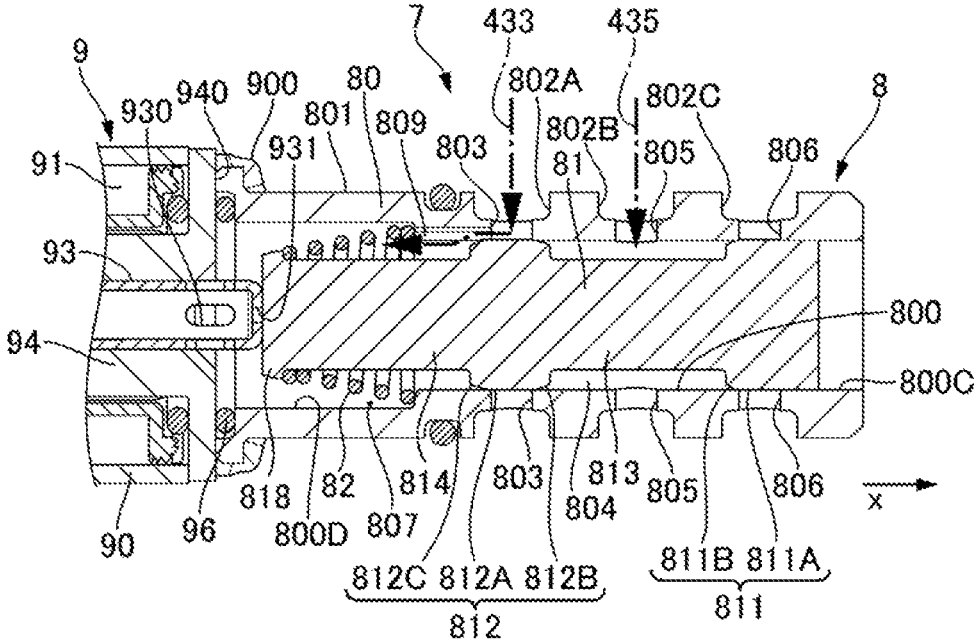
FIG. 16 is a cross-sectional view passing through the central axis of the control valve according to the fourth embodiment (the spool is located at the confinement position).

First, a configuration will be described. The fourth embodiment is different from the first embodiment only in terms of the configuration of the control valve 7. The control valve 7 is the control valve 7 according to the third embodiment in which the land portions 811 and 812 of the spool 81 thereof are modified into tapered shapes similar to the second land portion 812 according to the second embodiment. As illustrated in FIG. 15, the dimensions of the land portions 811 and 812 in the x-axis direction are larger than in the third embodiment. The first land portion 811 includes a main body portion 811A and an end portion 811B on the x-axis negative direction side. The second land portion 812 includes the main body portion 812A, the end portion 812B, and the end portion 812C. The dimensions of the main body portions 811A and 812A in the x-axis direction are equal to the dimensions of the land portions 811 and 812 according to the third embodiment in the x-axis direction, respectively. The shapes of the end portions 811B, 812B, and 812C are each a circular truncated cone-like shape (a shape cut out entirely in the circumferential direction) similarly to the end portions 812B and 812C according to the second embodiment. When the spool 81 is located at the initial position, the main body portions 811A and 812A are located at the same positions as the land portions 811 and 812 when the spool 81 is located at the initial position in the third embodiment, respectively. The end portion 812B is provided between the ends of the supply ports 803 on the x-axis positive direction side and the ends thereof on the x-axis negative direction side in the x-axis direction. As illustrated in FIG. 16, when the spool 81 is located at the confinement position, the main body portions 811A and 812A are located at the same positions as the land portions 811 and 812 when the spool 81 is located at the confinement position in the third embodiment, respectively. The other configuration is similar to the first embodiment, and therefore corresponding components will be identified by the same reference numerals and will not be redundantly described below.

Next, advantageous effects will be described. A gap between the outer peripheral surface of the end portion 811B and the inner peripheral surface 800 (the main body portion 800C) of the cylinder 80 can function as a flow passage of the hydraulic oil between the space 804 and the communication ports 806. The effect of the narrowed passage makes gentle the change in the flow rate of the hydraulic oil flowing from the second control chamber 292 into the discharge ports 806 via the space 804, and the change in the flow rate of the hydraulic oil flowing from the supply ports 803 into the space 804 (further flowing into the second control chamber 292 via the communication ports 805) according to the movement of the spool 81. Further, the effect of the narrowed passage makes gentle the change in the flow rate of the hydraulic oil flowing from the supply ports 803 into the space 807 via the groove 809. The behavior of the spool 81 is stabilized because the change in the pressure in the space 807 (which generates the hydraulic force Fp1) is reduced. Other advantageous effects brought about by the shapes of the land portions 811 and 812 are similar to the second embodiment. Other advantageous effects are similar to the third embodiment.

Fifth Embodiment

Figure 17:
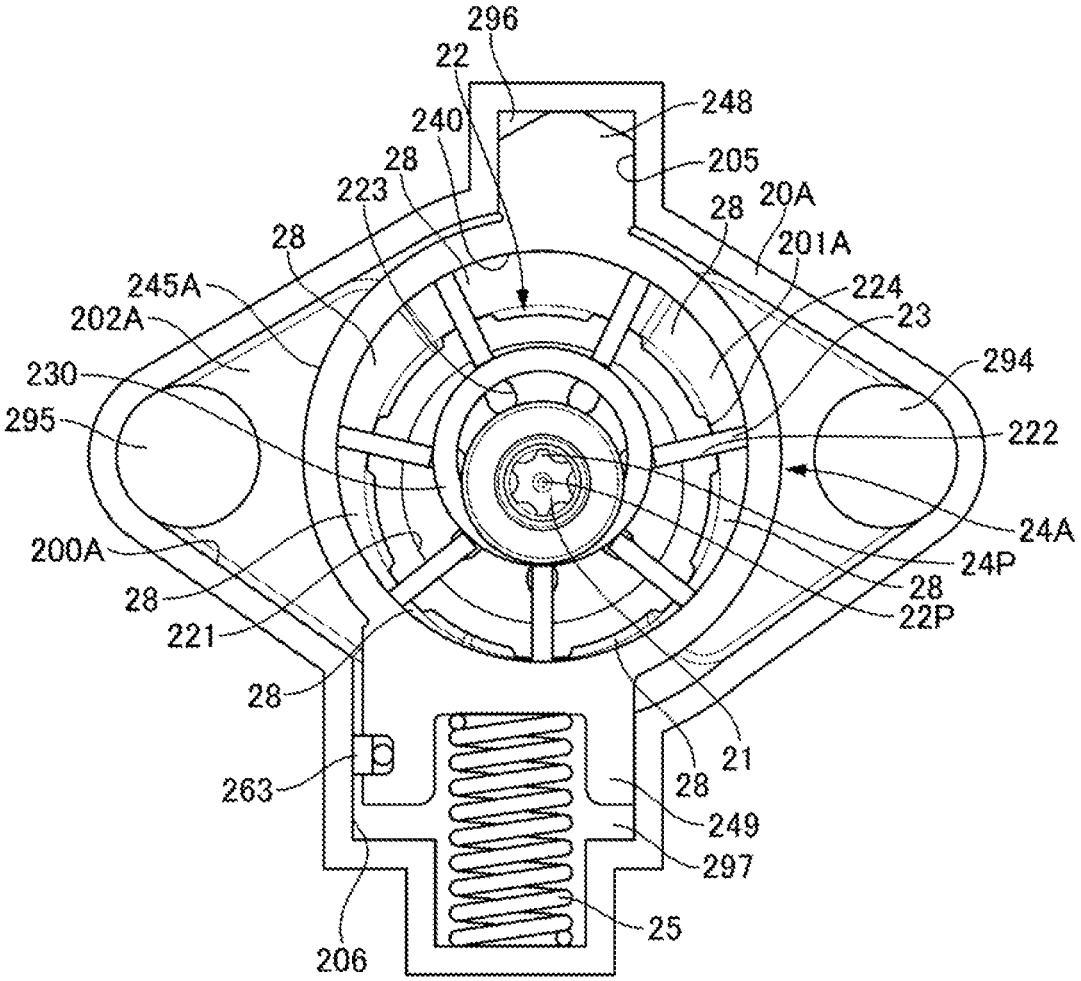
FIG. 17 is a front view of a part of a pump according to the fifth embodiment.

First, a configuration will be described. The fifth embodiment is different from the first embodiment only in terms of the configuration of the pump 2 except for the control mechanism 3. As illustrated in FIG. 17, the pump 2 includes a cam ring 24A that moves in a sliding manner. The pump 2 does not include the first seal member 261, the second seal member 262, and the pin 27 like the first embodiment. A pump containing chamber 200A of a housing main body 20A includes a bottomed cylindrical first recessed portion 205 and second recessed portion 206. Central axes of these recessed portions 205 and 206 extend linearly in a plane perpendicular to the central axis 22P of the rotor 22, and extend in parallel with each other. An outer periphery of the cam ring 24A includes a radially outwardly protruding first protrusion 248 and second protrusion 249. The protrusions 248 and 249 are located on opposite sides of the central axis 24P of the cam ring inner peripheral surface 240 from each other. Central axes of these protrusions 248 and 249 extend linearly in the plane perpendicular to the central axis 22P of the rotor 22, and extend in parallel with each other. The first protrusion 248 is contained in the first recessed portion 205, and the second protrusion 249 is contained in the second recessed portion 206. A seal member 263 is mounted on a part of an outer peripheral surface of the second protrusion 249. One end of the spring 25 is set at an axial end of the second protrusion 249.

An intake chamber 294, a discharge chamber 295, a first control chamber 296, and a second control chamber (a spring containing chamber) 297 are formed between the housing and the cam ring 24A inside the pump containing chamber 200A. The intake chamber 294 and the discharge chamber 295 are each a space between a portion of a cam ring outer peripheral surface 245A from the first protrusion 248 to the second protrusion 249, and the inner peripheral surface of the pump containing chamber 200A. An intake port 201A and an intake inlet are opened to the intake chamber 294. A discharge port 202A and a discharge outlet are opened to the discharge chamber 295. The intake port 201A is opened to the vane chambers 28 in the intake region and the discharge port 202A is opened to the vane chambers 28 in the discharge region on the inner peripheral side of the cam ring 24A. The first control chamber 296 is a space between an inner peripheral surface of the first recessed portion 205 and the first protrusion 248. The second control chamber 297 is a space between an inner peripheral surface of the second recessed portion 206 and the second protrusion 249. The other end of the spring 25 is set on the inner peripheral surface of the second recessed portion 206. A gap between the discharge chamber 295 and the second control chamber 297 is sealed by the seal member 263 except for a slight gap between a surface of the cam ring 24A on the axial side, and the bottom surface of the pump containing chamber 200A and a surface of a cover closing the pump containing chamber 200A. On the cam ring outer peripheral surface 245A, the area that receives the pressure P2 in the second control chamber 297 is larger than the area that receives the pressure P1 in the first control chamber 296. The first feedback passage 431 of the control passage 43 is connected to the first control chamber 296. The communication passage 435 of the second feedback passage 432 is connected to the second control chamber 297. The other configuration is similar to the first embodiment, and therefore corresponding components will be identified by the same reference numerals and will not be redundantly described below.

Figure 18:
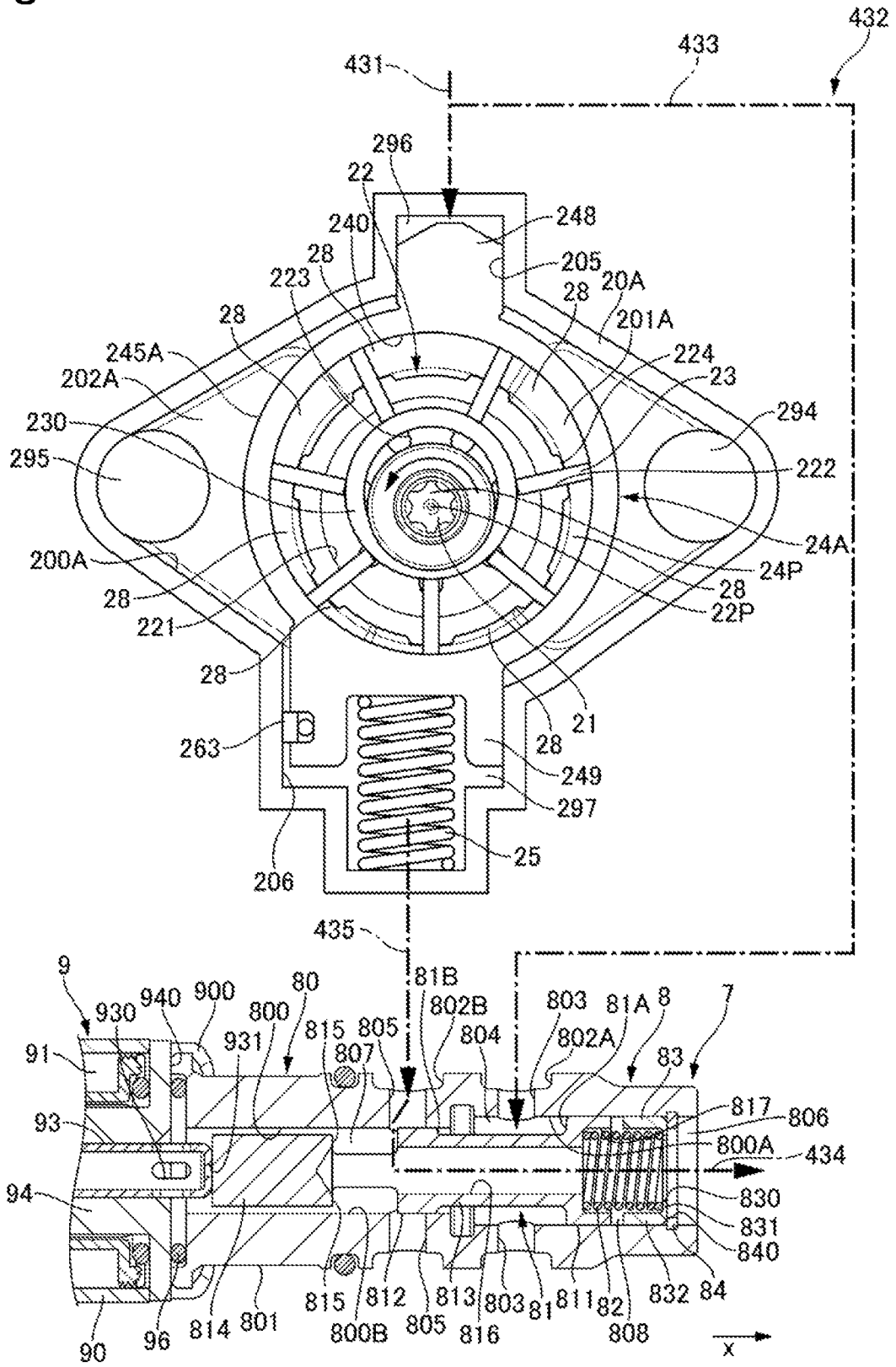
FIG. 18 illustrates an actuation state (the second state) of the pump according to the fifth embodiment.
Figure 19:
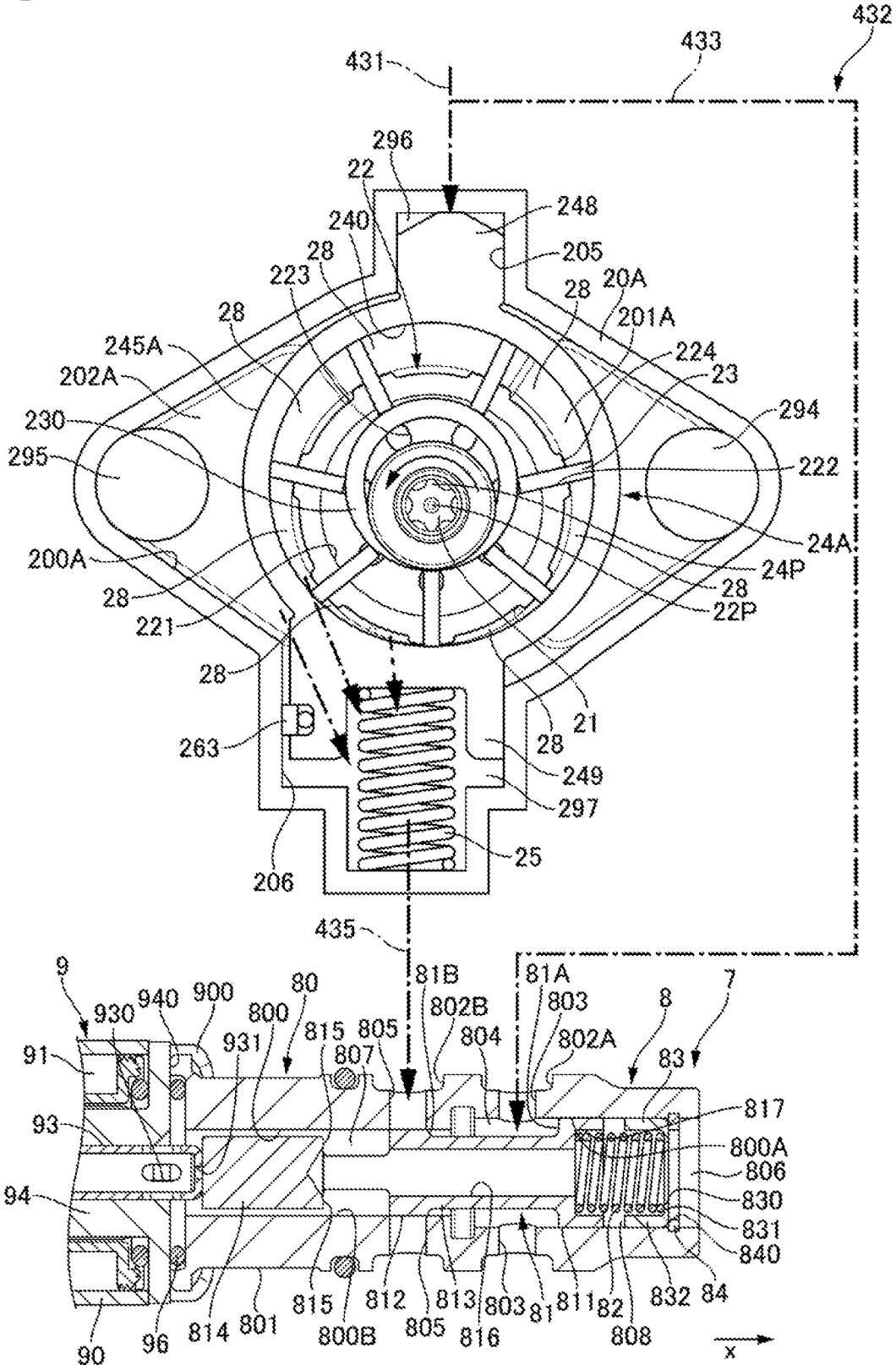
FIG. 19 illustrates an actuation state (the third state) of the pump according to the fifth embodiment.

Next, advantageous effects will be described. The rotor 22 rotates in the counterclockwise direction in each of FIGS. 17 to 19. The cam ring 24A is slidably movable along the central axes of the recessed portions 205 and 206 (movable linearly in the radial direction of the rotor 22) inside the pump containing chamber 200A. The recessed portions 205 and 206 function as a guide portion (a guide) of the above-described movement inside the pump containing chamber 200A. The translation movement of the cam ring 24A causes a change in the difference between the central axis 22P of the rotor 22A and the central axis 24P of the cam ring inner peripheral surface 240 (the eccentricity amount Δ). The volume of each of the control chambers 296 and 297 can change when the cam ring 24A moves. The position of the cam ring 24A (Δ) is determined based on the force Fp1 derived from the pressure P1 in the first control chamber 296, the force Fp2 derived from the pressure P2 in the second control chamber 297, and the biasing force Fs of the spring 25. In this manner, the pump 2 is configured in such a manner that Δ (the capacity) changes due to the translation movement of the cam ring 24A, thereby being able to simplify the structure of each of the control chambers 296 and 297. As illustrated in FIG. 18, the hydraulic oil is discharged from the second control chamber 297 by the movement of the spool 81 toward the x-axis positive direction side (the second state). At the time of the confinement control, as illustrated in FIG. 19, the spool 81 is located at the confinement position, by which the second control chamber 297 is closed from the supply and discharge passages 433 and 434 and the hydraulic oil is prohibited from being supplied into the second control chamber 297 and discharged from the second control chamber 297 (the third state). At this time, the pressure P2 in the second control chamber 297 can increase due to the hydraulic oil leaking into the second control chamber 297 by passing through the gap between the surface of the cam ring 24A on the axial side and the bottom surface of the pump containing chamber 200A and the like. Therefore, the pump 2 can allow the cam ring 24A to be stably actuated by canceling out the load (in the direction for reducing Δ) due to the loss of the pressure balance among the plurality of pump chambers (vane chambers 28) in the discharge region. The other advantageous effects are similar to the first embodiment. It is also possible to apply the control valve 7 according to any of the second to fourth embodiments to the present embodiment.

Other Embodiments

Having described the embodiments for implementing the present invention with reference to the drawings, the specific configuration of the present invention is not limited to the embodiments, and the present invention also includes a design modification and the like thereof made within a range that does not depart from the spirit of the present invention, if any. For example, the pump can be used for a hydraulic oil supply system of an apparatus different from the automobile and the engine. The specific configuration of the vane pump is not limited to the embodiments, and can be modified as necessary. The pump is not limited to the above-described example as long as it is the variable displacement pump, and a member different from the vane may be used as the pump forming member. A member different from the cam ring may be used as the movable member that changes the increase/reduction amount of the volume of each of the plurality of vane chambers during the rotation of the pump forming member. For example, the pump may be a trochoid-type gear pump. In this case, the pump can be configured as the variable displacement pump by eccentrically movably disposing an outer rotor, which is an external gear, and disposing the control chamber and the spring on an outer peripheral side thereof (the outer rotor corresponds to the movable member).

The calculation portion and reception portion of the ECU are realized by software in the microcomputer in the embodiments, but may be realized by an electronic circuit. The calculation refers to not only a calculation of an equation but also all kinds of processing on software. The reception portion may be an interface in the microcomputer or may be software in the microcomputer. The control signal may be a signal regarding the current value or may be a signal regarding the thrust force of the rod. The method for controlling the current to supply to the solenoid portion is not limited to the PWM control. The current value according to the engine operational state may be preset based on a map. Characteristic information that changes the current to supply to the solenoid portion according to the engine operational state may be realized by a calculation instead of being realized based on the map in the microcomputer.

Technical Ideas Recognizable from Embodiments

Technical ideas (or technical solutions, the same applies hereinafter) recognizable from the above-described embodiments will be described below.

(1) A variable displacement pump according to one technical idea of the present invention is, in one configuration thereof, a variable displacement pump configured to supply hydraulic oil. The variable displacement pump includes a housing including a containing chamber, a discharge port, and an intake port therein, a pump forming member provided in the containing chamber and configured to suck the hydraulic oil from the intake port and discharge the hydraulic oil to the discharge port by being rotationally driven, and a movable member provided in the containing chamber. The movable member defines a plurality of pump chambers by containing the pump forming member on an inner peripheral side thereof. The movable member is configured to change a change amount of a volume of each of the pump chambers when the pump forming member rotates due to a movement thereof. The variable displacement pump further includes a biasing member provided in the containing chamber and configured to bias the movable member in a direction for increasing the change amount of the volume of each of the pump chambers, and a first control chamber provided between an inner periphery of the containing chamber and an outer periphery of the movable member. The hydraulic oil is introduced from the discharge port into the first control chamber. The first control chamber has a volume that increases when the movable member moves in a direction counteracting the biasing force of the biasing member. The variable displacement pump further includes a second control chamber provided between the inner periphery of the containing chamber and the outer periphery of the movable member. The hydraulic oil is able to be introduced from the discharge port into the second control chamber via a supply/discharge passage or is able to be discharged from inside the second control chamber. The second control chamber has a volume that increases when the movable member moves in the same direction as the biasing force of the biasing member. The second control chamber is located adjacent to any of the plurality of pump chambers having a volume that reduces according to the rotation of the pump forming member or the discharge port via the movable member. The variable displacement pump further includes a control mechanism configured to be able to switch a state in which the second control chamber is opened to the supply/discharge passage and a state in which the second control chamber is closed to the supply/discharge passage.

(2) According to a further preferable configuration, in the above-described configuration, the control mechanism includes a cylinder including a supply/discharge port connected to the supply/discharge passage and a communication port connected to the second control chamber, a spool provided reciprocably in an axial direction inside the cylinder and configured to receive a pressure of the hydraulic oil delivered from the discharge port that is introduced from the supply/discharge port into the cylinder, and a solenoid configured to be able to generate an electromagnetic force that biases the spool in the axial direction.

(3) According to another preferable configuration, in any of the above-described configurations, the spool is biased by the pressure of the hydraulic oil toward one side in the axial direction. The control mechanism includes a spool biasing member configured to bias the spool toward the other side in the axial direction. The solenoid can generate the electromagnetic force that biases the spool toward the one side in the axial direction.

(4) According to further another preferable configuration, in any of the above-described configurations, the spool includes a first pressure-receiving surface that faces the other side in the axial direction and receives the pressure of the hydraulic oil, and a second pressure-receiving surface that faces the one side in the axial direction and receives the pressure of the hydraulic oil. The first pressure-receiving surface has an area larger than an area of the second pressure-receiving surface.

(5) According to further another preferable configuration, in any of the above-described configurations, the first pressure-receiving surface and the second pressure-receiving surface face each other in the axial direction, and define a space into which the hydraulic oil is introduced from the discharge port together with an inner peripheral surface of the cylinder.

(6) According to further another preferable configuration, in any of the above-described configurations, the spool includes a pressure-receiving surface that faces the other side in the axial direction and receives the pressure of the hydraulic oil. The pressure-receiving surface defines a space into which the hydraulic oil is introduced from the discharge port together with a surface fixed to the cylinder and facing one side in the axial direction and an inner peripheral surface of the cylinder.

(7) According to further another preferable configuration, in any of the above-described configurations, the spool includes a land portion capable of changing an area of an opening of the supply/discharge port or the communication port on the inner peripheral surface of the cylinder. A dimension of the land portion in the axial direction is larger than a dimension of the opening in the axial direction.

(8) According to further another preferable configuration, in any of the above-described configurations, an end portion of the land portion in the axial direction is shaped in such a manner that an outer peripheral surface is cut out at least in a circumferential direction of the spool.

(9) According to further another preferable configuration, in any of the above-described configurations, the entire end portion of the land portion in the circumferential direction is shaped in such a manner that the outer peripheral surface thereof is cut out.

(10) According to further another preferable configuration, in any of the above-described configurations, the supply/discharge passage for introducing the hydraulic oil from the discharge port into the second control chamber is at least partially placed outside the housing.

(11) According to further another preferable configuration, in any of the above-described configurations, the hydraulic pressure having a lower pressure than the discharge port is introduced into the second control chamber via the supply/discharge passage.

(12) According to further another preferable configuration, in any of the above-described configurations, an outer peripheral surface of the movable member includes a first pressure-receiving surface that receives a pressure of the hydraulic oil introduced into the first control chamber, and a second pressure-receiving surface that receives a pressure of the hydraulic oil introduced into the second control chamber. An area of the second pressure-receiving surface is larger than an area of the first pressure-receiving surface.

(13) According to further another preferable configuration, in any of the above-described configurations, the movable member can swing around a support point.

(14) According to further another preferable configuration, in any of the above-described configurations, the movable member is translatable.

(15) A method for controlling a variable displacement pump according to one technical idea of the present invention is, in one configuration thereof, a method for controlling a variable displacement pump configured to supply hydraulic oil. The variable displacement pump includes a housing including a containing chamber, a discharge port, and an intake port therein, a pump forming member provided in the containing chamber and configured to suck the hydraulic oil from the intake port and discharge the hydraulic oil to the discharge port by being rotationally driven, and a movable member provided in the containing chamber. The movable member defines a plurality of pump chambers by containing the pump forming member. The movable member is configured to change a change amount of a volume of each of the pump chambers when the pump forming member rotates due to a movement thereof. The variable displacement pump further includes a biasing member provided in the containing chamber and configured to bias the movable member in a direction for increasing the change amount of the volume of each of the pump chambers, and a first control chamber provided between an inner periphery of the containing chamber and an outer periphery of the movable member. The hydraulic oil is introduced from the discharge port into the first control chamber. The first control chamber has a volume that increases when the movable member moves in a direction counteracting the biasing force of the biasing member. The variable displacement pump further includes a second control chamber provided between the inner periphery of the containing chamber and the outer periphery of the movable member. The hydraulic oil is able to be introduced from the discharge port into the second control chamber via a supply/discharge passage or is able to be discharged from inside the second control chamber. The second control chamber has a volume that increases when the movable member moves in the same direction as the biasing force of the biasing member. The method for controlling the variable displacement pump includes closing the second control chamber to the supply/discharge passage during a predetermined period before the number of rotations of the pump forming member reaches a predetermined rotation number region, and, after that, opening the second control chamber to the supply/discharge passage when the number of rotations of the pump forming member reaches the predetermined rotation number region or around this region, when keeping the pressure of the hydraulic oil supplied by the variable displacement pump within a predetermined range while the number of rotations of the pump forming member falls within the predetermined rotation number region.

(16) Further, from another aspect, a method for controlling a variable displacement pump according to one technical idea of the present invention is, in one configuration thereof, a method for controlling a variable displacement pump configured to supply hydraulic oil. The variable displacement pump includes a housing including a containing chamber, a discharge port, and an intake port therein, a pump forming member provided in the containing chamber and configured to suck the hydraulic oil from the intake port and discharge the hydraulic oil to the discharge port by being rotationally driven, and a movable member provided in the containing chamber. The movable member defines a plurality of pump chambers by containing the pump forming member on an inner peripheral side thereof. The movable member is configured to change a change amount of a volume of each of the pump chambers when the pump forming member rotates due to a movement thereof. The variable displacement pump further includes a biasing member provided in the containing chamber and configured to bias the movable member in a direction for increasing the change amount of the volume of each of the pump chambers, and a first control chamber provided between an inner periphery of the containing chamber and an outer periphery of the movable member. The hydraulic oil is introduced from the discharge port into the first control chamber. The first control chamber has a volume that increases when the movable member moves in a direction counteracting the biasing force of the biasing member. The variable displacement pump further includes a second control chamber provided between the inner periphery of the containing chamber and the outer periphery of the movable member. The hydraulic oil is able to be introduced from the discharge port into the second control chamber via a supply/discharge passage or is able to be discharged from inside the second control chamber. The second control chamber has a volume that increases when the movable member moves in the same direction as the biasing force of the biasing member. The method for controlling the variable displacement pump includes closing the second control chamber to the supply/discharge passage during a predetermined period before a pressure of the hydraulic oil supplied by the variable displacement pump reaches a control hydraulic pressure, and, after that, opening the second control chamber to the supply/discharge passage when the pressure of the hydraulic oil supplied by the variable displacement pump reaches the control hydraulic pressure or around this pressure, when keeping the pressure of the hydraulic oil supplied by the variable displacement pump at the control hydraulic pressure after changing the pressure of the hydraulic oil supplied by the variable displacement pump toward the control hydraulic pressure.

(17) According to a further preferable configuration, in the above-described configuration, the variable displacement pump includes a cylinder including a supply/discharge port connected to the supply/discharge passage and a communication port connected to the second control chamber, a spool provided reciprocably in an axial direction inside the cylinder and configured to receive, in the axial direction, a pressure of the hydraulic oil delivered from the discharge port that is introduced from the supply/discharge port into the cylinder, and a solenoid configured to be able to generate an electromagnetic force that biases the spool in the axial direction. The control method further includes biasing the spool by the electromagnetic force of the solenoid so as to close the second control chamber to the supply/discharge passage during the predetermined period.

(18) According to another preferable configuration, in any of the above-described configurations, the spool is biased by the pressure of the hydraulic oil toward one side in the axial direction. The variable displacement pump includes a spool biasing member configured to bias the spool toward the other side in the axial direction. After the pressure of the hydraulic oil supplied by the variable displacement pump reaches the control hydraulic pressure or around this pressure, the spool moves toward the one side in the axial direction in such a manner that the hydraulic oil in the second control chamber is discharged via the supply/discharge passage if the pressure of the hydraulic oil supplied by the variable displacement pump is higher than the control hydraulic pressure, and the spool moves toward the other side in the axial direction in such a manner that the hydraulic oil is introduced from the discharge port into the second control chamber via the supply/discharge passage if the pressure of the hydraulic oil supplied by the variable displacement pump is lower than the control hydraulic pressure.

(19) Further, from another aspect, a method for controlling a variable displacement pump according to one technical idea of the present invention is, in one configuration thereof, a method for controlling a variable displacement pump configured to supply hydraulic oil to an internal combustion engine. The variable displacement pump includes a housing including a containing chamber, a discharge port, and an intake port therein, a pump forming member provided in the containing chamber and configured to suck the hydraulic oil from the intake port and discharge the hydraulic oil to the discharge port by being rotationally driven, and a movable member provided in the containing chamber. The movable member defines a plurality of pump chambers by containing the pump forming member. The movable member is configured to change a change amount of a volume of each of the pump chambers when the pump forming member rotates due to a movement thereof. The variable displacement pump further includes a biasing member provided in the containing chamber and configured to bias the movable member in a direction for increasing the change amount of the volume of each of the pump chambers, and a first control chamber provided between an inner periphery of the containing chamber and an outer periphery of the movable member. The hydraulic oil is introduced from the discharge port into the first control chamber. The first control chamber has a volume that increases when the movable member moves in a direction counteracting the biasing force of the biasing member. The variable displacement pump further includes a second control chamber provided between the inner periphery of the containing chamber and the outer periphery of the movable member. The hydraulic oil is able to be introduced from the discharge port into the second control chamber via a supply/discharge passage or is able to be discharged from inside the second control chamber. The second control chamber has a volume that increases when the movable member moves in the same direction as the biasing force of the biasing member. The variable displacement pump further includes a cylinder including a supply/discharge port connected to the supply/discharge passage and a communication port connected to the second control chamber, and a spool provided reciprocably in an axial direction inside the cylinder. The spool is configured to be able to change an area of an opening of the supply/discharge port or the communication port on an inner peripheral surface of the cylinder by moving. The spool is configured to receive, in the axial direction, a pressure of the hydraulic oil delivered from the discharge port that is introduced from the supply/discharge port into the cylinder. The variable displacement pump further includes a solenoid configured to be able to generate an electromagnetic force that biases the spool in the axial direction. The method for controlling the variable displacement pump includes reducing the area of the opening of the supply/discharge port or the communication port on the inner peripheral surface of the cylinder compared to after a pressure of the hydraulic oil reaches a control hydraulic pressure at least during a predetermined period until the pressure of the hydraulic oil supplied by the variable displacement pump reaches the control hydraulic pressure, when keeping the pressure of the hydraulic oil supplied by the variable displacement pump at the control hydraulic pressure after changing this pressure toward the control hydraulic pressure.

(20) According to a further preferable configuration, in the above-described configuration, the method for controlling the variable displacement pump includes adjusting the area of the opening of the supply/discharge port or the communication port on the inner peripheral surface of the cylinder in such a manner that an amount of the hydraulic oil introduced from any of the plurality of pump chambers having a volume that reduces according to the rotation of the pump forming member or the discharge port into the second control chamber via a gap between a surface of the movable member slidable relative to the inner surface of the containing chamber and the inner surface of the containing chamber exceeds an amount of the hydraulic oil discharged from the second control chamber via the supply/discharge passage, at least during the predetermined period until the pressure of the hydraulic oil supplied by the variable displacement pump reaches the control hydraulic pressure.

The present invention is not limited to the above-described embodiments, and includes various modifications. For example, the above-described embodiments have been described in detail to facilitate better understanding of the present invention, and the present invention shall not necessarily be limited to the configurations including all of the described features. Further, a part of the configuration of some embodiment can be replaced with the configuration of another embodiment. Further, some embodiment can also be implemented with a configuration of another embodiment added to the configuration of this embodiment. Further, each of the embodiments can also be implemented with another configuration added, deleted, or replaced with respect to a part of the configuration of this embodiment.

The present application claims priority under the Paris Convention to Japanese Patent Application No. 2017-121943 filed on Jun. 22, 2017. The entire disclosure of Japanese Patent Application No. 2017-121943 filed on Jun. 22, 2017 including the specification, the claims, the drawings, and the abstract is incorporated herein by reference in its entirety.

REFERENCE SIGN LIST

2 variable displacement pump
20 housing main body
200 pump containing chamber (containing chamber)

201 intake port
202 discharge port
23 vane (pump forming member)
24 cam ring (movable member)
25 spring (biasing member)
28 vane chamber (pump chamber)
291 first control chamber
292 second control chamber
3 control mechanism
433 supply passage (supply/discharge passage)
434 discharge passage (supply/discharge passage)
80 cylinder
803 supply port (supply/discharge port)
806 discharge port (supply/discharge port)
805 communication port
81 spool
82 spring (spool biasing member)
9 solenoid portion (solenoid)

The invention claimed is:

1. A variable displacement pump configured to supply hydraulic oil, the variable displacement pump comprising:

a housing including a containing chamber, a discharge port, and an intake port therein;

a pump provided in the containing chamber, the pump being configured to suck the hydraulic oil from the intake port and discharge the hydraulic oil to the discharge port by being rotationally driven;

a mover provided in the containing chamber, the mover defining a plurality of pump chambers by containing the pump on an inner peripheral side of the mover, the mover being configured to change a change amount of a volume of each of the pump chambers when the pump rotates due to a movement of the mover;

a biaser provided in the containing chamber, the biaser being configured to bias the mover in a direction for increasing the change amount of the volume of each of the pump chambers;

a first control chamber provided between an inner periphery of the containing chamber and an outer periphery of the mover, the hydraulic oil being introduced from the discharge port into the first control chamber, the first control chamber having a volume that increases when the mover moves in a direction counteracting the biasing force of the biaser;

a second control chamber provided between the inner periphery of the containing chamber and the outer periphery of the mover, the hydraulic oil being able to be introduced from the discharge port into the second control chamber via a supply/discharge passage or being able to be discharged from inside the second control chamber, the second control chamber having a volume that increases when the mover moves in the same direction as the biasing force of the biaser, the second control chamber being located adjacent to any of the plurality of pump chambers having a volume that reduces according to the rotation of the pump or the discharge port via the mover; and a controller configured to switch a state in which the second control chamber is opened to the supply/discharge passage and a state in which the second control chamber is closed to the supply/discharge passage, wherein the controller includes a cylinder including a supply/discharge port connected to the supply/discharge passage, and a communication port connected to the second control chamber, a spool provided reciprocably in an axial direction of the cylinder inside the cylinder, the spool being configured to receive a pressure of the hydraulic oil delivered from the discharge port that is introduced from the supply/discharge port into the cylinder, and a solenoid configured to generate an electromagnetic force that biases the spool in the axial direction, wherein the spool is biased by the pressure of the hydraulic oil toward one side in the axial direction, wherein the controller includes a spool biaser configured to bias the spool toward the other side in the axial direction, wherein the solenoid is configured to generate the electromagnetic force that biases the spool toward the one side in the axial direction, and wherein the spool includes a first pressure-receiving surface that faces the other side in the axial direction and receives the pressure of the hydraulic oil, and a second pressure-receiving surface that faces the one side in the axial direction and receives the pressure of the hydraulic oil, the first pressure-receiving surface having an area larger than an area of the second pressure-receiving surface.

2. The variable displacement pump according to claim 1, wherein the first pressure-receiving surface and the second pressure-receiving surface face each other in the axial direction, and define a space into which the hydraulic oil is introduced from the discharge port together with an inner peripheral surface of the cylinder.

3. The variable displacement pump according to claim 1, wherein the first pressure-receiving surface defines a space into which the hydraulic oil is introduced from the discharge port together with a surface fixed to the cylinder and facing one side in the axial direction and an inner peripheral surface of the cylinder.

4. The variable displacement pump according to claim 3, wherein the spool includes a land portion capable of changing an area of an opening of the supply/discharge port or the communication port on the inner peripheral surface of the cylinder, and wherein a dimension of the land portion in the axial direction is larger than a dimension of the opening in the axial direction.

5. The variable displacement pump according to claim 4, wherein an end portion of the land portion in the axial direction is shaped in such a manner that an outer peripheral surface is cut out at least in a circumferential direction of the spool.

6. The variable displacement pump according to claim 1, wherein an entire end portion of a land portion in a circumferential direction is shaped in such a manner that an outer peripheral surface of the land portion thereof is cut out.

7. The variable displacement pump according to claim 6, wherein the supply/discharge passage for introducing the hydraulic oil from the discharge port into the second control chamber is at least partially placed outside the housing.

8. The variable displacement pump according to claim 6, wherein the hydraulic oil having a lower pressure than the discharge port is introduced into the second control chamber via the supply/discharge passage.

9. The variable displacement pump according to claim 1, wherein an outer peripheral surface of the mover includes a first pressure- receiving surface that receives a pressure of the hydraulic oil introduced into the first control chamber, and a second pressure-receiving surface that receives a pressure of the hydraulic oil introduced into the second control chamber, and wherein an area of the second pressure-receiving surface is larger than an area of the first pressure-receiving surface.

10. The variable displacement pump according to claim 9, wherein the mover is configured to swing around a support point.

11. The variable displacement pump according to claim 1, wherein the mover is translatable.

12. A method for controlling a variable displacement pump configured to supply hydraulic oil, the variable displacement pump including a housing including a containing chamber, a discharge port, and an intake port therein, a pump provided in the containing chamber, the pump being configured to suck the hydraulic oil from the intake port and discharge the hydraulic oil to the discharge port by being rotationally driven, a mover provided in the containing chamber, the mover defining a plurality of pump chambers by containing the pump, the mover being configured to change a change amount of a volume of each of the pump chambers when the pump rotates due to a movement of the mover, a biaser provided in the containing chamber, the biaser being configured to bias the mover in a direction for increasing the change amount of the volume of each of the pump chambers, a first control chamber provided between an inner periphery of the containing chamber and an outer periphery of the mover, the hydraulic oil being introduced from the discharge port into the first control chamber, the first control chamber having a volume that increases when the mover moves in a direction counteracting the biasing force of the biaser, and a second control chamber provided between the inner periphery of the containing chamber and the outer periphery of the mover, the hydraulic oil being able to be introduced from the discharge port into the second control chamber via a supply/discharge passage or being able to be discharged from inside the second control chamber, the second control chamber having a volume that increases when the mover moves in the same direction as the biasing force of the biaser, the method for controlling the variable displacement pump comprising:

closing the second control chamber to the supply/discharge passage during a predetermined period before the number of rotations of the pump reaches a predetermined rotation number region, and, after that, opening the second control chamber to the supply/discharge passage when the number of rotations of the pump reaches the predetermined rotation number region or around the region, when keeping the pressure of the hydraulic oil supplied by the variable displacement pump device within a predetermined range while the number of rotations of the pump falls within the predetermined rotation number region.

13. A method for controlling a variable displacement pump configured to supply hydraulic oil, the variable displacement pump including a housing including a containing chamber, a discharge port, and an intake port therein, a pump provided in the containing chamber, the pump being configured to suck the hydraulic oil from the intake port and discharge the hydraulic oil to the discharge port by being rotationally driven, a mover provided in the containing chamber, the mover defining a plurality of pump chambers by containing the pump on an inner peripheral side of the mover, the mover being configured to change a change amount of a volume of each of the pump chambers when the pump rotates due to a movement of the mover, a biaser provided in the containing chamber, the biaser being configured to bias the mover in a direction for increasing the change amount of the volume of each of the pump chambers, a first control chamber provided between an inner periphery of the containing chamber and an outer periphery of the mover, the hydraulic oil being introduced from the discharge port into the first control chamber, the first control chamber having a volume that increases when the mover moves in a direction counteracting the biasing force of the biaser, and a second control chamber provided between the inner periphery of the containing chamber and the outer periphery of the mover, the hydraulic oil being able to be introduced from the discharge port into the second control chamber via a supply/discharge passage or being able to be discharged from inside the second control chamber, the second control chamber having a volume that increases when the mover moves in the same direction as the biasing force of the biaser, the method for controlling the variable displacement pump comprising:

closing the second control chamber to the supply/discharge passage during a predetermined period before a pressure of the hydraulic oil supplied by the variable displacement pump reaches a control hydraulic pressure, and, after that, opening the second control chamber to the supply/discharge passage when the pressure of the hydraulic oil supplied by the variable displacement pump reaches the control hydraulic pressure or around the pressure, when keeping the pressure of the hydraulic oil supplied by the variable displacement pump at the control hydraulic pressure after changing the pressure of the hydraulic oil supplied by the variable displacement pump toward the control hydraulic pressure.

14. The method for controlling the variable displacement pump according to claim 13, wherein the variable displacement pump includes a cylinder including a supply/discharge port connected to the supply/discharge passage, and a communication port connected to the second control chamber, a spool provided reciprocably in an axial direction of the cylinder inside the cylinder, the spool being configured to receive, in the axial direction, a pressure of the hydraulic oil delivered from the discharge port that is introduced from the supply/discharge port into the cylinder, and a solenoid configured to be able to generate an electromagnetic force that biases the spool in the axial direction, wherein the control method further includes biasing the spool by the electromagnetic force of the solenoid so as to close the second control chamber to the supply/discharge passage during the predetermined period.

15. The method for controlling the variable displacement pump according to claim 14, wherein the spool is biased by the pressure of the hydraulic oil toward one side in the axial direction, wherein the variable displacement pump device includes a spool biaser configured to bias the spool toward the other side in the axial direction, and wherein, after the pressure of the hydraulic oil supplied by the variable displacement pump reaches the control hydraulic pressure or around the pressure, the spool moves toward the one side in the axial direction in such a manner that the hydraulic oil in the second control chamber is discharged via the supply/discharge passage if the pressure of the hydraulic oil supplied by the variable displacement pump is higher than the control hydraulic pressure, and the spool moves toward the other side in the axial direction in such a manner that the hydraulic oil is introduced from the discharge port into the second control chamber via the supply/discharge passage if the pressure of the hydraulic oil supplied by the variable displacement pump is lower than the control hydraulic pressure.

16. A method for controlling a variable displacement pump configured to supply hydraulic oil to an internal combustion engine, the variable displacement pump including a housing including a containing chamber, a discharge port, and an intake port therein, a pump provided in the containing chamber, the pump being configured to suck the hydraulic oil from the intake port and discharge the hydraulic oil to the discharge port by being rotationally driven, a mover provided in the containing chamber, the mover defining a plurality of pump chambers by containing the pump, the mover being configured to change a change amount of a volume of each of the pump chambers when the pump rotates due to a movement of the mover, a biaser provided in the containing chamber, the biaser being configured to bias the mover in a direction for increasing the change amount of the volume of each of the pump chambers, a first control chamber provided between an inner periphery of the containing chamber and an outer periphery of the mover, the hydraulic oil being introduced from the discharge port into the first control chamber, the first control chamber having a volume that increases when the mover moves in a direction counteracting the biasing force of the biaser, a second control chamber provided between the inner periphery of the containing chamber and the outer periphery of the mover, the hydraulic oil being able to be introduced from the discharge port into the second control chamber via a supply/discharge passage or being able to be discharged from inside the second control chamber, the second control chamber having a volume that increases when the mover moves in the same direction as the biasing force of the biaser, a cylinder including a supply/discharge port connected to the supply/discharge passage, and a communication port connected to the second control chamber, a spool provided reciprocably in an axial direction of the cylinder inside the cylinder, the spool being configured to be able to change an area of an opening of the supply/discharge port or the communication port on an inner peripheral surface of the cylinder by moving, the spool being configured to receive, in the axial direction, a pressure of the hydraulic oil delivered from the discharge port that is introduced from the supply/discharge port into the cylinder, and a solenoid configured to be able to generate an electromagnetic force that biases the spool in the axial direction, the method for controlling the variable displacement pump comprising:

reducing the area of the opening of the supply/discharge port or the communication port on the inner peripheral surface of the cylinder compared to after a pressure of the hydraulic oil reaches a control hydraulic pressure at least during a predetermined period until the pressure of the hydraulic oil supplied by the variable displacement pump reaches the control hydraulic pressure, when keeping the pressure of the hydraulic oil supplied by the variable displacement pump at the control hydraulic pressure after changing the pressure toward the control hydraulic pressure.

17. The method for controlling the variable displacement pump device according to claim 16, comprising adjusting the area of the opening of the supply/discharge port or the communication port on the inner peripheral surface of the cylinder in such a manner that an amount of the hydraulic oil introduced from any of the plurality of pump chambers having a volume that reduces according to the rotation of the pump or the discharge port into the second control chamber via a gap between a surface of the mover slidable relative to the inner surface of the containing chamber and the inner surface of the containing chamber exceeds an amount of the hydraulic oil discharged from the second control chamber via the supply/discharge passage, at least during the predetermined period until the pressure of the hydraulic oil supplied by the variable displacement pump reaches the control hydraulic pressure.

* * * * *